US010573326B2

(12) United States Patent
Chebiyyam et al.

(10) Patent No.: US 10,573,326 B2
(45) Date of Patent: Feb. 25, 2020

(54) INTER-CHANNEL BANDWIDTH EXTENSION

(71) Applicant: QUALCOMM Incorporated, San Diego, CA (US)

(72) Inventors: Venkata Subrahmanyam Chandra Sekhar Chebiyyam, Santa Clara, CA (US); Venkatraman Atti, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 144 days.

(21) Appl. No.: 15/935,952

(22) Filed: Mar. 26, 2018

(65) Prior Publication Data

US 2018/0293992 A1 Oct. 11, 2018

Related U.S. Application Data

(60) Provisional application No. 62/482,150, filed on Apr. 5, 2017.

(51) Int. Cl.
*G10L 19/00* (2013.01)
*G10L 19/008* (2013.01)
(Continued)

(52) U.S. Cl.
CPC ..... *G10L 19/008* (2013.01); *G10L 19/06* (2013.01); *G10L 19/083* (2013.01); *H04S 3/008* (2013.01);
(Continued)

(58) Field of Classification Search
CPC ..... G10L 19/00
(Continued)

(56) References Cited

U.S. PATENT DOCUMENTS 7,280,959 B2 * 10/2007 Bessette ..... G10L 19/10 704/219
8,015,368 B2 * 9/2011 Sharma ..... G06F 9/30014 704/500
(Continued)

FOREIGN PATENT DOCUMENTS

WO 2017161313 A1 9/2017
WO 2018005079 A1 1/2018

OTHER PUBLICATIONS

3GPP TS 26.290: "3rd Generation Partnership Project; Technical Specification Group Services and System Aspects; Audio Codec Processing Functions; Extended Adaptive Multi-Rate-Wideband (AMR-WB+) Codec; Transcoding Functions", Version 13.0.0, Release 13, Mobile Competence Centre; 650, Route Des Lucioles; F-06921 Sophia-Antipolis Cedex; France, vol. SA WG4, No. V13.0.0, Dec. 13, 2015 (Dec. 13, 2015), pp. 1-85, XP051046634 [retrieved on Dec. 13, 2015].
(Continued)

*Primary Examiner* — Michael C Colucci
(74) *Attorney, Agent, or Firm* — Moore Intellectual Property Law, PLLC

(57) ABSTRACT

A method includes decoding a low-band mid channel bitstream to generate a low-band mid signal and a low-band mid excitation signal. The method further includes decoding a high-band mid channel bandwidth extension bitstream to generate a synthesized high-band mid signal. The method also includes determining an inter-channel bandwidth extension (ICBWE) gain mapping parameter corresponding to the synthesized high-band mid signal. The ICBWE gain mapping parameter is based on a selected frequency-domain gain parameter that is extracted from a stereo downmix/upmix parameter bitstream. The method further includes performing a gain scaling operation on the synthesized high-band mid signal based on the ICBWE gain mapping parameter to generate a reference high-band channel and a target high-band channel. The method includes outputting a first audio channel and a second audio channel. The first audio channel is based on the reference high-band channel, and the second audio channel is based on target high-band channel.

30 Claims, 6 Drawing Sheets

(51) Int. Cl.
*G10L 19/06* (2013.01)
*G10L 19/083* (2013.01)
*H04S 3/00* (2006.01)

(52) U.S. Cl.
CPC ..... *H04S 2400/03* (2013.01); *H04S 2400/13* (2013.01)

(58) Field of Classification Search
USPC ..... 704/500, 210, 207, 219; 700/94; 455/205; 381/22; 711/147
See application file for complete search history.

(56) References Cited

U.S. PATENT DOCUMENTS 8,494,863 B2 * 7/2013 Biswas ..... G10L 19/008 704/500
8,605,911 B2 * 12/2013 Henn ..... G10L 19/008 381/22
8,818,541 B2 * 8/2014 Villemoes ..... G10L 21/0388 700/94
10,431,231 B2 * 10/2019 Atti ..... G10L 21/038
2006/0277036 A1 * 12/2006 Bessette ..... G10L 19/26 704/207
2008/0027717 A1 * 1/2008 Rajendran ..... G10L 19/24 704/210
2009/0313028 A1 * 12/2009 Tammi ..... G10L 19/265 704/500
2009/0325524 A1 * 12/2009 Oh ..... G10L 19/008 455/205
2012/0316885 A1 * 12/2012 Gibbs ..... G10L 19/0208 704/500
2015/0380008 A1 * 12/2015 Atti ..... G10L 19/265 704/500
2017/0270935 A1 * 9/2017 Atti ..... G10L 19/008
2018/0025738 A1 * 1/2018 Villemoes ..... G10L 19/035 704/500
2019/0005973 A1 * 1/2019 Atti ..... G10L 19/008

OTHER PUBLICATIONS

International Search Report and Written Opinion—PCT/US2018/024500—ISA/EPO—dated Jun. 8, 2018.

* cited by examiner

INTER-CHANNEL BANDWIDTH EXTENSION

I. CROSS REFERENCE TO RELATED APPLICATIONS

The present application claims the benefit of U.S. Provisional Patent Application No. 62/482,150, entitled "INTER-CHANNEL BANDWIDTH EXTENSION," filed Apr. 5, 2017, which is expressly incorporated by reference herein in its entirety.

II. FIELD

The present disclosure is generally related to encoding of multiple audio signals.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A computing device may include multiple microphones to receive audio channels. For example, a first microphone may receive a left audio channel, and a second microphone may receive a corresponding right audio channel. In stereo-encoding, an encoder may transform the left audio channel and the corresponding right audio channel into a frequency domain to generate a left frequency-domain channel and a right frequency-domain channel, respectively. The encoder may downmix the frequency-domain channels to generate a mid channel. An inverse transform may be applied to the mid channel to generate a time-domain mid channel, and a low-band encoder may encode a low-band portion of the time-domain mid channel to generate an encoded low-band mid channel. *A* mid channel bandwidth extension (BWE) encoder may generate mid channel BWE parameters (e.g., linear prediction coefficients (LPCs), gain shapes, a gain frame, etc.) based on the time-domain mid channel and an excitation of the encoded low-band mid channel. The encoder may generate a bitstream that includes the encoded low-band mid channel and the mid channel BWE parameters.

The encoder may also extract stereo parameters (e.g., Discrete Fourier Transform (DFT) downmix parameters) from the frequency-domain channels (e.g., the left frequency-domain channel and the right frequency-domain channel). The stereo parameters may include frequency-domain gain parameters (e.g., side gains), inter-channel phase difference (IPD) parameters, inter-channel level differences (ILD), diffusion spread/gains, and inter-channel BWE (ICBWE) gain mapping parameters. The stereo parameters may also include inter-channel time differences (ITD) estimated based on the time-domain and/or frequency-domain analysis of the left and right stereo channels. The stereo parameters may be inserted (e.g., included or encoded) in the bitstream, and the bitstream may be transmitted from the encoder to a decoder.

IV. SUMMARY

According to one implementation, a device includes a receiver configured to receive a bitstream from an encoder. The bitstream includes at least a low-band mid channel bitstream, a high-band mid channel bandwidth extension (BWE) bitstream, and a stereo downmix/upmix parameter bitstream. The device also includes a decoder configured to decode the low-band mid channel bitstream to generate a low-band mid signal and a low-band mid excitation signal. The decoder is further configured to generate a non-linear harmonic extension of the low-band mid excitation signal corresponding to a high-band BWE portion. The decoder is further configured to decode the high-band mid channel BWE bitstream to generate a synthesized high-band mid signal based at least on the non-linear harmonic excitation signal and high-band mid channel BWE parameters (e.g., linear prediction coefficients (LPCs), gain shapes, and gain frame parameters). The decoder is also configured to determine an inter-channel bandwidth extension (ICBWE) gain mapping parameter corresponding to the synthesized high-band mid signal. The ICBWE gain mapping parameter is determined (e.g., predicted, derived, guided, or mapped) based on a selected frequency-domain (e.g., a group of sub-bands or frequency bins corresponding to the high band BWE portion) gain parameter that is extracted from the stereo downmix/upmix parameter bitstream. For wideband content, the decoder is further configured to perform a gain scaling operation on the synthesized high-band mid signal based on the ICBWE gain mapping parameter to generate a reference high-band channel and a target high-band channel. The device also includes one or more speakers configured to output a first audio channel and a second audio channel. The first audio channel is based on the reference high-band channel, and the second audio channel is based on target high-band channel.

According to another implementation, a method of decoding a signal includes receiving a bitstream from an encoder. The bitstream includes at least a low-band mid channel bitstream, a high-band mid channel bandwidth extension (BWE) bitstream, and a stereo downmix/upmix parameter bitstream. The method also includes decoding the low-band mid channel bitstream to generate a low-band mid signal and a low-band mid excitation signal. The method also includes generating a non-linear harmonic extension of the low-band mid excitation signal corresponding to a high-band BWE portion. The method also includes decoding the high-band mid channel BWE bitstream to generate a synthesized high-band mid signal based at least on the non-linear harmonic excitation signal and high-band mid channel BWE parameters (e.g., linear prediction coefficients (LPCs), gain shapes, and gain frame parameters). The method also includes determining an inter-channel bandwidth extension (ICBWE) gain mapping parameter corresponding to the synthesized high-band mid signal. The ICBWE gain mapping parameter is determined (e.g., predicted, derived, guided, or mapped) based on a selected frequency-domain (e.g., a group of sub-bands or frequency bins corresponding to the high band BWE portion) gain parameter that is extracted from the stereo downmix/upmix parameter bitstream. The method further includes performing a gain scaling operation on the synthesized high-band mid signal based on the ICBWE gain mapping parameter to generate a reference high-band channel and a target high-band channel.

The method also includes outputting a first audio channel and a second audio channel. The first audio channel is based on the reference high-band channel, and the second audio channel is based on target high-band channel.

According to another implementation, a non-transitory computer-readable medium includes instructions for decoding a signal. The instructions, when executed by a processor within a decoder, cause the processor to perform operations including receiving a bitstream from an encoder. The bitstream includes at least a low-band mid channel bitstream, a high-band mid channel bandwidth extension (BWE) bitstream, and a stereo downmix/upmix parameter bitstream. The operations also include decoding the low-band mid channel bitstream to generate a low-band mid signal and a low-band mid excitation signal. The operations also include generating a non-linear harmonic extension of the low-band mid excitation signal corresponding to a high-band BWE portion. The operations also include decoding the high-band mid channel BWE bitstream to generate a synthesized high-band mid signal based at least on the non-linear harmonic excitation signal and high-band mid channel BWE parameters (e.g., linear prediction coefficients (LPCs), gain shapes, and gain frame parameters). The operations also include determining an inter-channel bandwidth extension (ICBWE) gain mapping parameter corresponding to the synthesized high-band mid signal. The ICBWE gain mapping parameter is determined (e.g., predicted, derived, guided, or mapped) based on a selected frequency-domain (e.g., a group of sub-bands or frequency bins corresponding to the high band BWE portion) gain parameter that is extracted from the stereo downmix/upmix parameter bitstream. The operations further include performing a gain scaling operation on the synthesized high-band mid signal based on the ICBWE gain mapping parameter to generate a reference high-band channel and a target high-band channel. The operations also include outputting a first audio channel and a second audio channel. The first audio channel is based on the reference high-band channel, and the second audio channel is based on target high-band channel.

According to another implementation, an apparatus includes means for receiving a bitstream from an encoder. The bitstream includes at least a low-band mid channel bitstream, a high-band mid channel bandwidth extension (BWE) bitstream, and a stereo downmix/upmix parameter bitstream. The apparatus also includes means for decoding the low-band mid channel bitstream to generate a low-band mid signal and a low-band mid excitation signal. The apparatus also includes means for generating a non-linear harmonic extension of the low-band mid excitation signal corresponding to a high-band BWE portion. The apparatus also includes means for decoding the high-band mid channel BWE bitstream to generate a synthesized high-band mid signal based at least on the non-linear harmonic excitation signal and high-band mid channel BWE parameters (e.g., linear prediction coefficients (LPCs), gain shapes, and gain frame parameters). The apparatus also includes means for determining an inter-channel bandwidth extension (ICBWE) gain mapping parameter corresponding to the synthesized high-band mid signal. The ICBWE gain mapping parameter is determined (e.g., predicted, derived, guided, or mapped) based on a selected frequency-domain (e.g., a group of sub-bands or frequency bins corresponding to the high band BWE portion) gain parameter that is extracted from the stereo downmix/upmix parameter bitstream. The apparatus also includes means for performing a gain scaling operation on the synthesized high-band mid signal based on the ICBWE gain mapping parameter to generate a reference high-band channel and a target high-band channel. The apparatus also includes means for outputting a first audio channel and a second audio channel. The first audio channel is based on the reference high-band channel, and the second audio channel is based on target high-band channel.

Other implementations, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
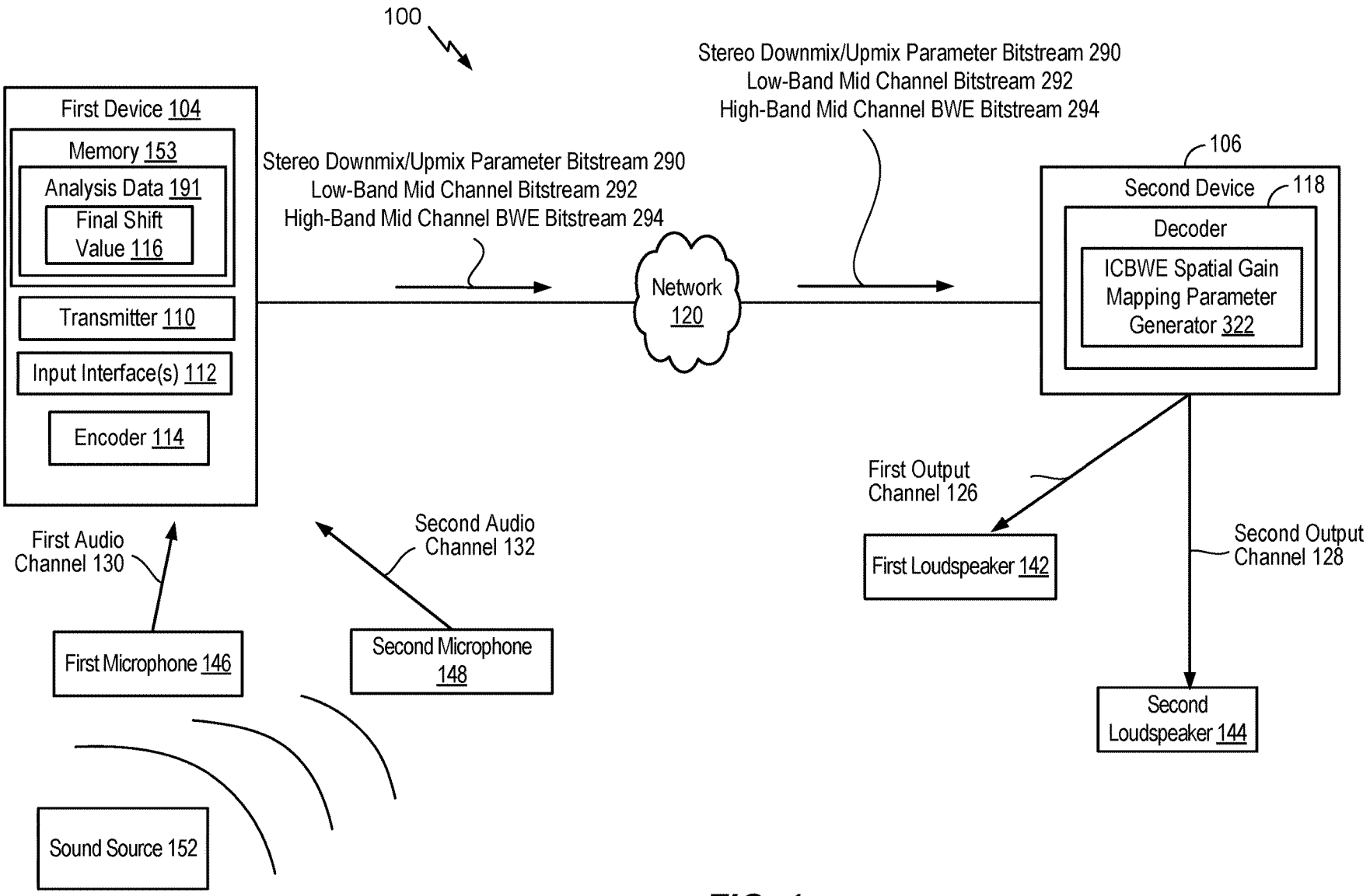
FIG. 1 is a block diagram of a particular illustrative example of a system that includes a decoder operable to determine inter-channel bandwidth extension (ICBWE) mapping parameters based on a frequency-domain gain parameter transmitted from an encoder.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprises" and "comprising" may be used interchangeably with "includes" or "including." Additionally, it will be understood that the term "wherein" may be used interchangeably with "where." As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "using", "selecting", "accessing", "identifying", and "determining" may be used interchangeably. For example, "generating", "calculating", or "determining" a parameter (or a signal) may refer to actively generating, calculating, or determining the parameter (or the signal) or may refer to using, selecting, or accessing the parameter (or signal) that is already generated, such as by another component or device.

Systems and devices operable to encode multiple audio signals are disclosed. A device may include an encoder configured to encode the multiple audio signals. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted. The speech/audio from a given source (e.g., a talker) may arrive at the multiple microphones at different times depending on how the microphones are arranged as well as where the source (e.g., the talker) is located with respect to the microphones and room dimensions. For example, a sound source (e.g., a talker) may be closer to a first microphone associated with the device than to a second microphone associated with the device. Thus, a sound emitted from the sound source may reach the first microphone earlier in time than the second microphone. The device may receive a first audio signal via the first microphone and may receive a second audio signal via the second microphone.

Mid-side (MS) coding and parametric stereo (PS) coding are stereo coding techniques that may provide improved efficiency over the dual-mono coding techniques. In dual-mono coding, the Left (L) channel (or signal) and the Right (R) channel (or signal) are independently coded without making use of inter-channel correlation. MS coding reduces the redundancy between a correlated L/R channel-pair by transforming the Left channel and the Right channel to a sum-channel and a difference-channel (e.g., a side channel) prior to coding. The sum signal and the difference signal are waveform coded or coded based on a model in MS coding. Relatively more bits are spent on the sum signal than on the side signal. PS coding reduces redundancy in each sub-band or frequency-band by transforming the L/R signals into a sum signal and a set of side parameters. The side parameters may indicate an inter-channel intensity difference (IID), an inter-channel phase difference (IPD), an inter-channel time difference (ITD), side or residual prediction gains, etc. The sum signal is waveform coded and transmitted along with the side parameters. In a hybrid system, the side-channel may be waveform coded in the lower bands (e.g., less than 2 kilohertz (kHz)) and PS coded in the upper bands (e.g., greater than or equal to 2 kHz) where the inter-channel phase preservation is perceptually less critical. In some implementations, the PS coding may be used in the lower bands also to reduce the inter-channel redundancy before waveform coding.

The MS coding and the PS coding may be done in either the frequency-domain or in the sub-band domain. In some examples, the Left channel and the Right channel may be uncorrelated. For example, the Left channel and the Right channel may include uncorrelated synthetic signals. When the Left channel and the Right channel are uncorrelated, the coding efficiency of the MS coding, the PS coding, or both, may approach the coding efficiency of the dual-mono coding.

Depending on a recording configuration, there may be a temporal mismatch between a Left channel and a Right channel, as well as other spatial effects such as echo and room reverberation. If the temporal and phase mismatch between the channels are not compensated, the sum channel and the difference channel may contain comparable energies reducing the coding-gains associated with MS or PS techniques. The reduction in the coding-gains may be based on the amount of temporal (or phase) shift. The comparable energies of the sum signal and the difference signal may limit the usage of MS coding in certain frames where the channels are temporally shifted but are highly correlated. In stereo coding, a Mid channel (e.g., a sum channel) and a Side channel (e.g., a difference channel) may be generated based on the following Formula:

$$M=(L+R)/2, S=(L-R)/2, \quad \text{Formula 1}$$

where M corresponds to the Mid channel, S corresponds to the Side channel, L corresponds to the Left channel, and R corresponds to the Right channel.

In some cases, the Mid channel and the Side channel may be generated based on the following Formula:

$$M=c(L+R), S=c(L-R), \quad \text{Formula 2}$$

where c corresponds to a complex value which is frequency dependent. Generating the Mid channel and the Side channel based on Formula 1 or Formula 2 may be referred to as performing a "down-mixing" algorithm. A reverse process of generating the Left channel and the Right channel from the Mid channel and the Side channel based on Formula 1 or Formula 2 may be referred to as performing an "up-mixing" algorithm.

In some cases, the Mid channel may be based other formulas such as:

$$M=(L+g_D R)/2, \text{ or} \quad \text{Formula 3}$$

$$M=g_1 L+g_2 R \quad \text{Formula 4}$$

where $g_1+g_2=1.0$, and where $g_D$ is a gain parameter. In other examples, the down-mix may be performed in bands, where $mid(b)=c_1L(b)+c_2R(b)$, where $c_1$ and $c_2$ are complex numbers, where $side(b)=c_3L(b)-c_4R(b)$, and where $c_3$ and $c_4$ are complex numbers.

An ad-hoc approach used to choose between MS coding or dual-mono coding for a particular frame may include generating a mid channel and a side channel, calculating energies of the mid channel and the side channel, and determining whether to perform MS coding based on the energies. For example, MS coding may be performed in response to determining that the ratio of energies of the side channel and the mid channel is less than a threshold. To illustrate, if a Right channel is shifted by at least a first time (e.g., about 0.001 seconds or 48 samples at 48 kHz), a first energy of the mid channel (corresponding to a sum of the left signal and the right signal) may be comparable to a second energy of the side channel (corresponding to a difference between the left signal and the right signal) for voiced speech frames. When the first energy is comparable to the second energy, a higher number of bits may be used to encode the Side channel, thereby reducing coding efficiency of MS coding relative to dual-mono coding. Dual-mono coding may thus be used when the first energy is comparable to the second energy (e.g., when the ratio of the first energy and the second energy is greater than or equal to a threshold). In an alternative approach, the decision between MS coding and dual-mono coding for a particular frame may be made based on a comparison of a threshold and normalized cross-correlation values of the Left channel and the Right channel.

In some examples, the encoder may determine a mismatch value indicative of an amount of temporal mismatch between the first audio signal and the second audio signal. As used herein, a "temporal shift value", a "shift value", and a "mismatch value" may be used interchangeably. For example, the encoder may determine a temporal shift value indicative of a shift (e.g., the temporal mismatch) of the first audio signal relative to the second audio signal. The shift value may correspond to an amount of temporal delay between receipt of the first audio signal at the first microphone and receipt of the second audio signal at the second microphone. Furthermore, the encoder may determine the shift value on a frame-by-frame basis, e.g., based on each 20 milliseconds (ms) speech/audio frame. For example, the shift value may correspond to an amount of time that a second frame of the second audio signal is delayed with respect to a first frame of the first audio signal. Alternatively, the shift value may correspond to an amount of time that the first frame of the first audio signal is delayed with respect to the second frame of the second audio signal.

When the sound source is closer to the first microphone than to the second microphone, frames of the second audio signal may be delayed relative to frames of the first audio signal. In this case, the first audio signal may be referred to as the "reference audio signal" or "reference channel" and the delayed second audio signal may be referred to as the "target audio signal" or "target channel". Alternatively, when the sound source is closer to the second microphone than to the first microphone, frames of the first audio signal may be delayed relative to frames of the second audio signal. In this case, the second audio signal may be referred to as the reference audio signal or reference channel and the delayed first audio signal may be referred to as the target audio signal or target channel.

Depending on where the sound sources (e.g., talkers) are located in a conference or telepresence room or how the sound source (e.g., talker) position changes relative to the microphones, the reference channel and the target channel may change from one frame to another; similarly, the temporal mismatch value may also change from one frame to another. However, in some implementations, the shift value may always be positive to indicate an amount of delay of the "target" channel relative to the "reference" channel. Furthermore, the shift value may correspond to a "non-causal shift" value by which the delayed target channel is "pulled back" in time such that the target channel is aligned (e.g., maximally aligned) with the "reference" channel at the encoder. The down-mix algorithm to determine the mid channel and the side channel may be performed on the reference channel and the non-causal shifted target channel.

The encoder may determine the shift value based on the reference audio channel and a plurality of shift values applied to the target audio channel. For example, a first frame of the reference audio channel, X, may be received at a first time ($m_1$). A first particular frame of the target audio channel, Y, may be received at a second time ($n_1$) corresponding to a first shift value, e.g., $shift1=n_1-m_1$. Further, a second frame of the reference audio channel may be received at a third time ($m_2$). A second particular frame of the target audio channel may be received at a fourth time ($n_2$) corresponding to a second shift value, e.g., $shift2=n_2-m_2$.

The device may perform a framing or a buffering algorithm to generate a frame (e.g., 20 ms samples) at a first sampling rate (e.g., 32 kHz sampling rate (i.e., 640 samples per frame)). The encoder may, in response to determining that a first frame of the first audio signal and a second frame of the second audio signal arrive at the same time at the device, estimate a shift value (e.g., shift1) as equal to zero samples. A Left channel (e.g., corresponding to the first audio signal) and a Right channel (e.g., corresponding to the second audio signal) may be temporally aligned. In some cases, the Left channel and the Right channel, even when aligned, may differ in energy due to various reasons (e.g., microphone calibration).

In some examples, the Left channel and the Right channel may be temporally misaligned due to various reasons (e.g., a sound source, such as a talker, may be closer to one of the microphones than another and the two microphones may be greater than a threshold (e.g., 1-20 centimeters) distance apart). A location of the sound source relative to the microphones may introduce different delays in the first channel and the second channel. In addition, there may be a gain difference, an energy difference, or a level difference between the first channel and the second channel.

In some examples, where there are more than two channels, a reference channel is initially selected based on the levels or energies of the channels, and subsequently refined based on the temporal mismatch values between different pairs of the channels, e.g., t1(ref, ch2), t2(ref, ch3), t3(ref, ch4), . . . t3(ref, chN), where ch1 is the ref channel initially and t1(.), t2(.), etc. are the functions to estimate the mismatch values. If all temporal mismatch values are positive, then ch1 is treated as the reference channel. If any of the mismatch values is a negative value, then the reference channel is reconfigured to the channel that was associated with a mismatch value that resulted in a negative value and the above process is continued until the best selection (i.e., based on maximally decorrelating maximum number of side channels) of the reference channel is achieved. A hysteresis may be used to overcome any sudden variations in reference channel selection.

In some examples, a time of arrival of audio signals at the microphones from multiple sound sources (e.g., talkers) may vary when the multiple talkers are alternatively talking (e.g., without overlap). In such a case, the encoder may dynamically adjust a temporal shift value based on the talker to identify the reference channel. In some other examples, multiple talkers may be talking at the same time, which may result in varying temporal shift values depending on who is the loudest talker, closest to the microphone, etc. In such a case, identification of reference and target channels may be based on the varying temporal shift values in the current frame, the estimated temporal mismatch values in the previous frames, and the energy (or temporal evolution) of the first and second audio signals.

In some examples, the first audio signal and second audio signal may be synthesized or artificially generated when the two signals potentially show less (e.g., no) correlation. It should be understood that the examples described herein are illustrative and may be instructive in determining a relationship between the first audio signal and the second audio signal in similar or different situations.

The encoder may generate comparison values (e.g., difference values or cross-correlation values) based on a comparison of a first frame of the first audio signal and a plurality of frames of the second audio signal. Each frame of the plurality of frames may correspond to a particular shift value. The encoder may generate a first estimated shift value based on the comparison values. For example, the first estimated shift value may correspond to a comparison value indicating a higher temporal-similarity (or lower difference) between the first frame of the first audio signal and a corresponding first frame of the second audio signal.

The encoder may determine the final shift value by refining, in multiple stages, a series of estimated shift values. For example, the encoder may first estimate a "tentative" shift value based on comparison values generated from stereo pre-processed and re-sampled versions of the first audio signal and the second audio signal. The encoder may generate interpolated comparison values associated with shift values proximate to the estimated "tentative" shift value. The encoder may determine a second estimated "interpolated" shift value based on the interpolated comparison values. For example, the second estimated "interpolated" shift value may correspond to a particular interpolated comparison value that indicates a higher temporal-similarity (or lower difference) than the remaining interpolated comparison values and the first estimated "tentative" shift value. If the second estimated "interpolated" shift value of the current frame (e.g., the first frame of the first audio signal) is different than a final shift value of a previous frame (e.g., a frame of the first audio signal that precedes the first frame), then the "interpolated" shift value of the current frame is further "amended" to improve the temporal-similarity between the first audio signal and the shifted second audio signal. In particular, a third estimated "amended" shift value may correspond to a more accurate measure of temporal-similarity by searching around the second estimated "interpolated" shift value of the current frame and the final estimated shift value of the previous frame. The third estimated "amended" shift value is further conditioned to estimate the final shift value by limiting any spurious changes in the shift value between frames and further controlled to not switch from a negative shift value to a positive shift value (or vice versa) in two successive (or consecutive) frames as described herein.

In some examples, the encoder may refrain from switching between a positive shift value and a negative shift value or vice-versa in consecutive frames or in adjacent frames. For example, the encoder may set the final shift value to a particular value (e.g., 0) indicating no temporal-shift based on the estimated "interpolated" or "amended" shift value of the first frame and a corresponding estimated "interpolated" or "amended" or final shift value in a particular frame that precedes the first frame. To illustrate, the encoder may set the final shift value of the current frame (e.g., the first frame) to indicate no temporal-shift, i.e., shift1=0, in response to determining that one of the estimated "tentative" or "interpolated" or "amended" shift value of the current frame is positive and the other of the estimated "tentative" or "interpolated" or "amended" or "final" estimated shift value of the previous frame (e.g., the frame preceding the first frame) is negative. Alternatively, the encoder may also set the final shift value of the current frame (e.g., the first frame) to indicate no temporal-shift, i.e., shift1=0, in response to determining that one of the estimated "tentative" or "interpolated" or "amended" shift value of the current frame is negative and the other of the estimated "tentative" or "interpolated" or "amended" or "final" estimated shift value of the previous frame (e.g., the frame preceding the first frame) is positive.

It should be noted that in some implementations, the estimation of the final shift value may be performed in the transform domain where the inter-channel cross-correlations may be estimated in the frequency domain. As an example, the estimation of the final shift value may largely be based on the Generalized cross correlation-Phase transform (GCC-PHAT) algorithm.

The encoder may select a frame of the first audio signal or the second audio signal as a "reference" or "target" based on the shift value. For example, in response to determining that the final shift value is positive, the encoder may generate a reference channel or signal indicator having a first value (e.g., 0) indicating that the first audio signal is a "reference" channel and that the second audio signal is the "target" channel. Alternatively, in response to determining that the final shift value is negative, the encoder may generate the reference channel or signal indicator having a second value (e.g., 1) indicating that the second audio signal is the "reference" channel and that the first audio signal is the "target" channel.

The encoder may estimate a relative gain (e.g., a relative gain parameter) associated with the reference channel and the non-causal shifted target channel. For example, in response to determining that the final shift value is positive, the encoder may estimate a gain value to normalize or equalize the energy or power levels of the first audio signal relative to the second audio signal that is offset by the non-causal shift value (e.g., an absolute value of the final shift value). Alternatively, in response to determining that the final shift value is negative, the encoder may estimate a gain value to normalize or equalize the power or amplitude levels of the first audio signal relative to the second audio signal. In some examples, the encoder may estimate a gain value to normalize or equalize the amplitude or power levels of the "reference" channel relative to the non-causal shifted "target" channel. In other examples, the encoder may estimate the gain value (e.g., a relative gain value) based on the reference channel relative to the target channel (e.g., the unshifted target channel).

The encoder may generate at least one encoded signal (e.g., a mid channel, a side channel, or both) based on the reference channel, the target channel, the non-causal shift value, and the relative gain parameter. In other implementations, the encoder may generate at least one encoded signal (e.g., a mid channel, a side channel, or both) based on the reference channel and the temporal-mismatch adjusted target channel. The side channel may correspond to a difference between first samples of the first frame of the first audio signal and selected samples of a selected frame of the second audio signal. The encoder may select the selected frame based on the final shift value. Fewer bits may be used to encode the side channel signal because of reduced difference between the first samples and the selected samples as compared to other samples of the second audio signal that correspond to a frame of the second audio signal that is received by the device at the same time as the first frame. A transmitter of the device may transmit the at least one encoded signal, the non-causal shift value, the relative gain parameter, the reference channel or signal indicator, or a combination thereof.

The encoder may generate at least one encoded signal (e.g., a mid channel, a side channel, or both) based on the reference channel, the target channel, the non-causal shift value, the relative gain parameter, low band parameters of a particular frame of the first audio signal, high band parameters of the particular frame, or a combination thereof. The particular frame may precede the first frame. Certain low band parameters, high band parameters, or a combination thereof, from one or more preceding frames may be used to encode a mid channel, a side channel, or both, of the first frame. Encoding the mid channel, the side channel, or both, based on the low band parameters, the high band parameters, or a combination thereof, may include estimates of the non-causal shift value and inter-channel relative gain parameter. The low band parameters, the high band parameters, or a combination thereof, may include a pitch parameter, a voicing parameter, a coder type parameter, a low-band energy parameter, a high-band energy parameter, a tilt parameter, a pitch gain parameter, a FCB gain parameter, a coding mode parameter, a voice activity parameter, a noise estimate parameter, a signal-to-noise ratio parameter, a formant shaping parameter, a speech/music decision parameter, the non-causal shift, the inter-channel gain parameter, or a combination thereof. A transmitter of the device may transmit the at least one encoded signal, the non-causal shift value, the relative gain parameter, the reference channel (or signal) indicator, or a combination thereof.

According to some encoding implementations, the encoder may transform a left audio channel and a corresponding right audio channel into a frequency domain to generate a left frequency-domain channel and a right frequency-domain channel, respectively. The encoder may downmix the frequency-domain channels to generate a mid channel. An inverse transform may be applied to the mid channel to generate a time-domain mid channel, and a low-band encoder may encode a low-band portion of the time-domain mid channel to generate an encoded low-band mid channel. A mid channel bandwidth extension (BWE) encoder may generate mid channel BWE parameters (e.g., linear prediction coefficients (LPCs), gain shapes, a gain frame, etc.). In some implementations, the mid channel BWE encoder generates the mid channel BWE parameters based on the time-domain mid channel and an excitation of the encoded low-band mid channel. The encoder may generate a bitstream that includes the encoded low-band mid channel and the mid channel BWE parameters.

The encoder may also extract stereo parameters (e.g., Discrete Fourier Transform (DFT) downmix parameters) from the frequency-domain channels (e.g., the left frequency-domain channel and the right frequency-domain channel). The stereo parameters may include frequency-domain gain parameters (e.g., side gains or Inter-channel level differences (ILDs)), inter-channel phase difference (IPD) parameters, stereo filling gains, etc. The stereo parameters may be inserted (e.g., included or encoded) in the bitstream, and the bitstream may be transmitted from the encoder to a decoder. According to one implementation, the stereo parameters may include inter-channel BWE (ICBWE) gain mapping parameters. However, the ICBWE gain mapping parameters may be somewhat "redundant" with respect to the other stereo parameters. Thus, to reduce coding complexity and redundant transmission, the ICBWE gain mapping parameters may not be extracted from the frequency-domain channels. For example, the encoder may bypass determining ICBWE gain parameters from the frequency-domain channels.

Upon reception of the bitstream from the encoder, the decoder may decode the encoded low-band mid channel to generate a low-band mid signal and a low-band mid excitation signal. The mid channel BWE parameters (received from the encoder) may be decoded using the low-band mid channel excitation to generate a synthesized high-band mid signal. A left high-band channel and right high-band channel may be generated by applying ICBWE gain mapping parameters to the synthesized high-band mid signal. However, because ICBWE gain mapping parameters are not included as part of the bitstream, the decoder may generate an ICBWE gain mapping parameter based on the frequency-domain gain parameters (e.g., the side gains or ILDs). The decoder may also generate the ICBWE gain mapping parameters based on the high-band mid synthesis signal, the low-band mid synthesis (or excitation) signal, and the low-band side (e.g., residual prediction) synthesis signal.

For example, the decoder may extract the frequency-domain gain parameters from the bitstream and select a frequency-domain gain parameter that is associated with a frequency range of the synthesized high-band mid signal. To illustrate, for Wideband coding, the synthesized high-band mid signal may have a frequency range between 6.4 kilohertz (kHz) and 8 kHz. If a particular frequency-domain gain parameter is associated with a frequency range between 5.2 kHz and 8.56 kHz, the particular frequency-domain gain parameter may be selected to generate the ICBWE gain mapping parameter. In another example, if one or more groups of frequency-domain gain parameters is associated with one or more sets of frequency ranges, e.g., 6.0-7.0 kHz, 7.0-8.0 kHz, then the one or more groups of stereo downmix/upmix gain parameters are selected to generate the ICBWE gain mapping parameter. According to one implementation, the ICBWE gain mapping parameter (gsMapping) may be determined based on the selected frequency-domain gain parameter (sidegain) using the following example:

$$\text{ICBWE gain Mapping parameter}, gs\text{Mapping}=(1-\text{side gain})$$

Once the ICBWE gain mapping parameter is determined (e.g., extracted), the left high-band channel and the right high-band channel may be synthesized using a gain scaling operation. For example, the synthesized high-band mid signal may be scaled by the ICBWE gain mapping parameter to generate the target high-band channel, and the synthesized high-band mid signal may be scaled by a modified ICBWE gain mapping parameter (e.g., 2−gsMapping or $\sqrt{2-\text{gsMapping}^2}$) to generate the reference high-band channel.

A left low-band channel and a right low-band channel may be generated based on an upmix operation associated with a frequency-domain version of the low-band mid signal. For example, the low-band mid signal may be converted to the frequency domain, the stereo parameters may be used to upmix the frequency-domain version of the low-band mid signal to generate frequency-domain left and right low-band channels, and inverse transform operations may be performed on the frequency-domain left and right low-band channels to generate the left low-band channel and the right low-band channel, respectively. The left low-band channel may be combined with the left high-band channel to generate a left-channel that is substantially similar to the left audio channel, and the right low-band channel may be combined with the right high-band channel to generate a right channel (that is substantially similar to the right audio channel.

Thus, encoding complexity and transmission bandwidth may be reduced by omitting extraction and transmission of the ICBWE gain mapping parameters at the encoder depending on the input content bandwidth. For example, the ICBWE gain mapping parameters may not be transmitted for WB multichannel coding, however, they are transmitted for super-wideband or full-band multichannel coding. In particular, the ICBWE gain mapping parameters may be generated at the decoder for wideband signals based on other stereo parameters (e.g., frequency-domain gain parameters) included in the bitstream. In other implementations, the ICBWE gain mapping parameters may also be generated based on the high-band (i.e., BWE) mid synthesis signal, the low-band mid synthesis (or excitation) signal, and the low-band side (e.g., residual prediction) synthesis signal.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 may include an encoder 114, a transmitter 110, one or more input interfaces 112, or a combination thereof. A first input interface of the input interfaces 112 may be coupled to a first microphone 146. A second input interface of the input interface(s) 112 may be coupled to a second microphone 148. The first device 104 may also include a memory 153 configured to store analysis data 191. The second device 106 may include a decoder 118. The decoder 118 may include an inter-channel bandwidth extension (ICBWE) gain mapping parameter generator 322. The second device 106 may be coupled to a first loudspeaker 142, a second loudspeaker 144, or both.

During operation, the first device 104 may receive a first audio channel 130 via the first input interface from the first microphone 146 and may receive a second audio channel 132 via the second input interface from the second microphone 148. The first audio channel 130 may correspond to one of a right channel signal or a left channel signal. The second audio channel 132 may correspond to the other of the right channel signal or the left channel signal. For ease of description and illustration, unless otherwise stated, the first audio channel 130 corresponds to the left audio channel, and the second audio channel 132 corresponds to the right audio channel. A sound source 152 (e.g., a user, a speaker, ambient noise, a musical instrument, etc.) may be closer to the first microphone 146 than to the second microphone 148. Accordingly, an audio signal from the sound source 152 may be received at the input interface(s) 112 via the first microphone 146 at an earlier time than via the second microphone 148. This natural delay in the multi-channel signal acquisition through the multiple microphones may introduce a temporal shift between the first audio channel 130 and the second audio channel 132.

The encoder 114 may be configured to determine a shift value (e.g., a final shift value 116) indicating a temporal shift between the audio channel 130, 132. The final shift value 116 may be stored in the memory 153 as analysis data 191 and encoded into a stereo downmix/upmix parameter bitstream 290 as a stereo parameter. The encoder 114 may also be configured to transform the audio channels 130, 132 into the frequency domain to generate frequency-domain audio channels. The frequency-domain audio channels may be down mixed to generate a mid channel, and a low-band portion of a time domain version of the mid channel may be encoded into a low-band mid channel bitstream 292. The encoder 114 may also generate mid channel BWE parameters (e.g., linear prediction coefficients (LPCs), gain shapes, a gain frame, etc.) based on the time-domain mid channel and an excitation of the encoded low-band mid channel. The encoder 114 may encode the mid channel BWE parameters as a high-band mid channel BWE bitstream 294.

The encoder 114 may also extract stereo parameters (e.g., Discrete Fourier Transform (DFT) downmix parameters) from the frequency-domain audio channels. The stereo parameters may include frequency-domain gain parameters (e.g., side gains), inter-channel phase difference (IPD) parameters, stereo filling gains, etc. The stereo parameters may be inserted in the stereo downmix/upmix parameter bitstream 290. Because, the ICBWE gain mapping parameters can be determined or estimated using the other stereo parameters, ICBWE gain mapping parameters may not be extracted from the frequency-domain audio channels to reduce coding complexity and redundant transmission. The transmitter may transmit the stereo downmix/upmix parameter bitstream 290, the low-band mid channel bitstream 292, and the high-band mid channel BWE bitstream 294 to the second device 106 via the network 120. Operations associated with the encoder 114 are described in greater detail with respect to FIG. 2.

The decoder 118 may perform decoding operations based on the stereo downmix/upmix parameter bitstream 290, the low-band mid channel bitstream 292, and the high-band mid channel BWE bitstream 294. The decoder 118 may decode the low-band mid channel bitstream 292 to generate a low-band mid signal and a low-band mid excitation signal. The high-band mid channel BWE bitstream 294 may be decoded using the low-band mid excitation signal to generate a synthesized high-band mid signal. A left high-band channel and right high-band channel may be generated by applying ICBWE gain mapping parameters to the synthesized high-band mid signal. However, because ICBWE gain mapping parameters are not included as part of the bitstream, the decoder 118 may generate an ICBWE gain mapping parameter based on frequency-domain gain parameters associated with the stereo downmix/upmix parameter bitstream 290.

For example, the decoder 118 may include an ICBWE spatial gain mapping parameter generator 322 configured to extract the frequency-domain gain parameters from the stereo downmix/upmix parameter bitstream 290 and configured to select a frequency-domain gain parameter that is associated with a frequency range of the synthesized high-band mid signal. To illustrate, for Wideband coding, the synthesized high-band mid signal may have a frequency range between 6.4 kilohertz (kHz) and 8 kHz. If a particular frequency-domain gain parameter is associated with a frequency range between 5.2 kHz and 8.56 kHz, the particular frequency-domain gain parameter may be selected to generate the ICBWE gain mapping parameter. According to one implementation, the ICBWE gain mapping parameter (gsMapping) may be determined based on the selected frequency-domain gain parameter (sidegain) using the following equation:

$$gsMapping = \frac{2}{1 + \frac{1 + sidegain}{1 - sidegain}}$$

Once the ICBWE gain mapping parameter is determined, the left high-band channel and the right high-band channel may be synthesized using a gain scaling operation. A left low-band channel and a right low-band channel may be generated based on an upmix operation associated with a frequency-domain version of the low-band mid signal. The left low-band channel may be combined with the left high-band channel to generate a first output channel 126 (e.g., a left-channel) that is substantially similar to the first audio channel 130, and the right low-band channel may be combined with the right high-band channel to generate a second output channel 128 (e.g., a right channel) that is substantially similar to the second audio channel 132. The first loudspeaker 142 may output the first output channel 126, and the second loudspeaker 144 may output the second output channel 128. Operations associated with the decoder 118 are described in greater detail with respect to FIG. 3.

Thus, encoding complexity and transmission bandwidth may be reduced by omitting extraction and transmission of the ICBWE gain mapping parameters at the encoder. The ICBWE gain mapping parameters may be generated at the decoder based on other stereo parameters (e.g., frequency-domain gain parameters) included in the bitstream.

Figure 2:
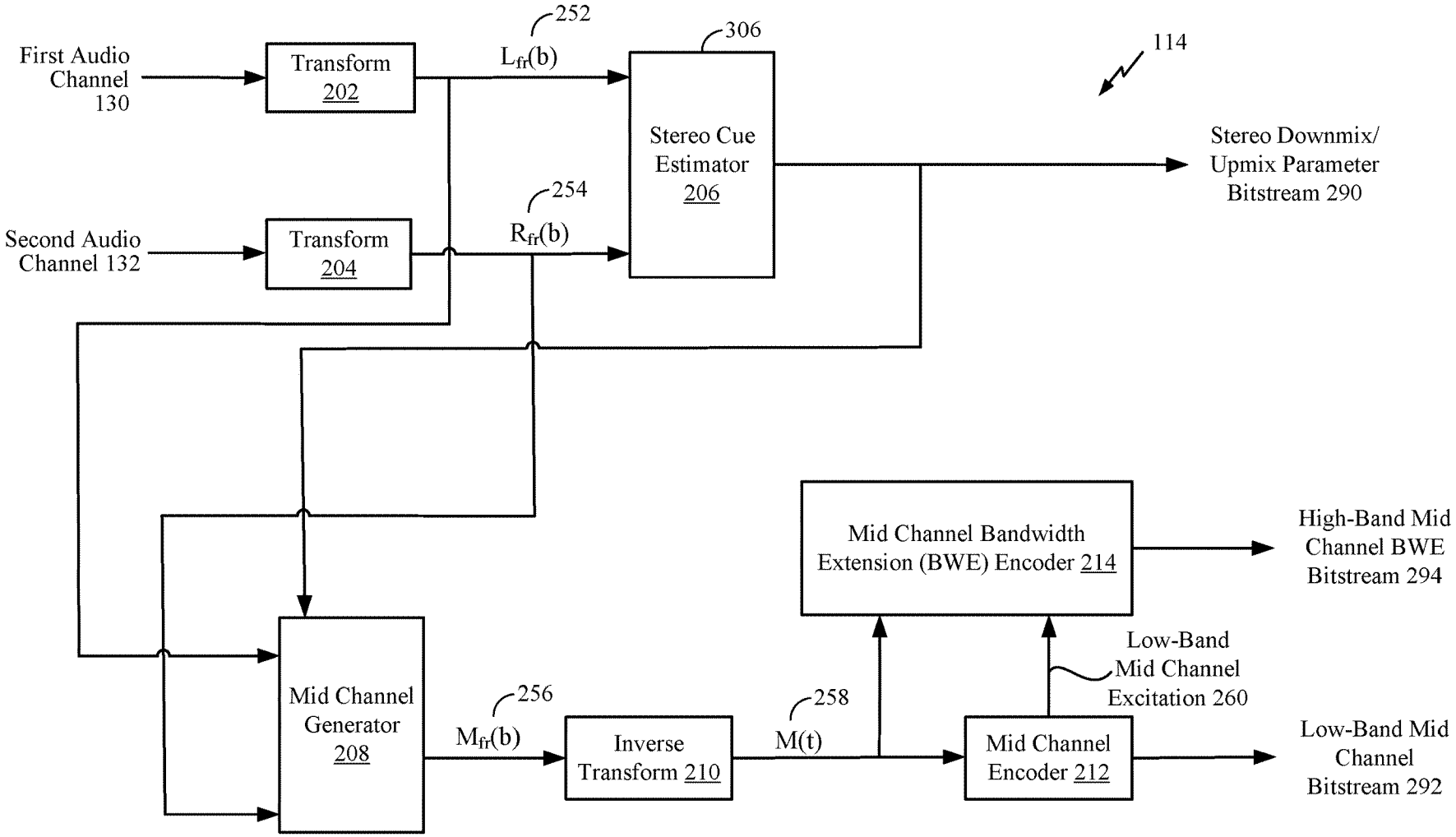
FIG. 2 is a diagram illustrating the encoder of FIG. 1.

Referring to FIG. 2, a particular implementation of the encoder 114 is shown. The encoder 114 includes a transform unit 202, a transform unit 204, a stereo cue estimator 206, a mid channel generator 208, an inverse transform unit 210, a mid channel encoder 212, and a mid channel BWE encoder 214.

The first audio channel 130 (e.g., the left channel) may be provided to the transform unit 202, and the second audio channel 132 (e.g., the right channel) may be provided to the transform unit 204. The transform unit 202 may be configured to perform a windowing operation and a transform operation on the first audio channel 130 to generate a first frequency-domain audio channel $L_{fr}(b)$ 252, and the transform unit 204 may be configured to perform a windowing operation and a transform operation on the second audio channel 132 to generate a second frequency-domain audio channel $R_{fr}(b)$ 254. For example, the transform units 202, 204 may apply Discrete Fourier Transform (DFT) operations, Fast Fourier Transform (FFT) operations, MDCT operations, etc., on the audio channels 130, 132, respectively. According to some implementations, Quadrature Mirror Filterbank (QMF) operations may be used to split the audio channel 130, 132 into multiple sub-bands. The first frequency-domain audio channel 252 is provided to the stereo cue estimator 206 and to the mid channel generator 208. The second frequency-domain audio channel 254 is also provided to the stereo cue estimator 206 and to the mid channel generator 208.

The stereo cue estimator 206 may be configured to extract (e.g., generate) stereo cues from the frequency-domain audio channels 252, 254 to generate the stereo downmix/upmix parameter bitstream 290. Non-limiting examples of the stereo cues (e.g., DFT downmix parameters) encoded into the stereo downmix/upmix parameter bitstream 290 may include frequency-domain gain parameters (e.g., side gains), inter-channel phase difference (IPD) parameters, stereo filling or residual prediction gains, etc. According to one implementation, the stereo cues may include ICBWE gain mapping parameters. However, the ICBWE gain mapping parameters can be determined or estimated based on the other stereo cues. Thus, to reduce coding complexity and redundant transmission, the ICBWE gain mapping parameters may not be extracted (e.g., the ICBWE gain mapping parameters are not encoded into the stereo downmix/upmix parameter bitstream 290). The stereo cues may be inserted (e.g., included or encoded) in the stereo downmix/upmix parameter bitstream 290, and the stereo downmix/upmix parameter bitstream 290 may be transmitted from the encoder 114 to the decoder 118. The stereo cues may also be provided to the mid channel generator 208.

The mid channel generator 208 may generate a frequency-domain mid channel $M_{fr}(b)$ 256 based on the frequency-domain first frequency-domain audio channel 252 and the second frequency-domain audio channel 254. According to some implementations, the frequency-domain mid channel $M_{fr}(b)$ 256 may be generated also based on the stereo cues. Some methods of generation of the frequency-domain mid channel 256 based on the frequency-domain audio channels 252, 254 and the stereo cues are as follows:

$$M_{fr}(b)=(L_{fr}(b)+R_{fr}(b))/2$$

$$M_{fr}(b)=c1(b)*L_{fr}(b)+c_2*R_{fr}(b),$$

where $c_1(b)$ and $c_2(b)$ are downmix parameters per frequency band.

In some implementations, the downmix parameters $c_1(b)$ and $c_2(b)$ are based on the stereo cues. For example, in one implementation of mid side down-mix when IPDs are estimated, $c_1(b)=(\cos(-\gamma)-i*\sin(-\gamma))/2^{0.5}$ and $c_2(b)=(\cos(IPD(b)-\gamma)+i*\sin(IPD(b)-\gamma))/2^{0.5}$ where i is the imaginary number signifying the square root of −1. In other examples, the mid channel may also be based on a shift value (e.g., the final shift value 116). In such implementations, the left and the right channels may be temporally aligned based on an estimate of the shift value prior to estimation of the frequency-domain mid channel. In some implementations, this temporal alignment can be performed in the time domain on the first and second audio channels 130, 132 directly. In other implementations, the temporal alignment can be performed in the transform domain on $L_{fr}(b)$ and $R_{fr}(b)$ by applying phase rotation to achieve the effect of temporal shifting. In some implementations, the temporal alignment of the channels may be performed as a non-causal shift operation performed on the target channel. While in other implementations, the temporal alignment may be performed as a causal shift operation on the reference channel or a causal/non-causal shift operation on the reference/target channels, respectively. In some implementations, the information about the reference and the target channels may be captured as a reference channel indicator (which could be estimated based on the sign of the final shift value 116). In some implementations, the information about the reference channel indicator and the shift value may be included as a part of the bitstream output of the encoder.

The frequency-domain mid channel 256 is provided to the inverse transform unit 210. The inverse transform unit 210 may perform an inverse transform operation on the frequency-domain mid channel 256 to generate a time-domain mid channel M(t) 258. Thus, the frequency-domain mid channel 256 may be inverse-transformed to time-domain, or transformed to MDCT domain for coding. The time-domain mid channel 258 is provided to the mid channel encoder 212 and to the mid channel BWE encoder 214.

The mid channel encoder 212 may be configured to encode a low-band portion of the time-domain mid channel 258 to generate the low-band mid channel bitstream 292. The low-band mid channel bitstream 292 may be transmitted from the encoder 114 to the decoder 118. The mid channel encoder 212 may be configured to generate a low-band mid channel excitation 260 of the low-band mid channel. The low-band mid channel excitation 260 is provided to the mid channel BWE encoder 214.

The mid channel BWE encoder 214 may generate mid channel BWE parameters (e.g., linear prediction coefficients (LPCs), gain shapes, a gain frame, etc.) based on the time-domain mid channel 258 and the low-band mid channel excitation 260. The mid channel BWE encoder 214 may encode the mid channel BWE parameters into the high-band mid channel BWE bitstream 294. The high-band mid channel BWE bitstream 294 may be transmitted from the encoder 114 to the decoder 116.

According to one implementation, the mid channel BWE encoder 214 may encode the mid high-band channel using a high-band coding algorithm based on a time-domain bandwidth extension (TBE) model. The TBE coding of the mid high-band channel may produce a set of LPC parameters, a high-band overall gain parameter, and high-band temporal gain shape parameters. The mid channel BWE encoder 214 may generate a set of mid high-band gain parameters corresponding to the mid high-band channel. For example, the mid channel BWE encoder 214 may generate a synthesized mid high-band channel based on the LPC parameters and may generate the mid high-band gain parameter based on a comparison of the mid high-band signal and the synthesized mid high-band signal. The mid channel BWE encoder 214 may also generate at least one adjustment gain parameter, at least one adjustment spectral shape parameter, or a combination thereof, as described herein. The mid channel BWE encoder 214 may transmit the LPC parameters (e.g., mid high-band LPC parameters), the set of mid high-band gain parameters, the at least one adjustment gain parameter, the at least one spectral shape parameter, or a combination thereof. The LPC parameters, the mid high-band gain parameter, or both, may correspond to an encoded version of the mid high-band signal.

Thus, the encoder 114 may generate the stereo downmix/upmix parameter bitstream 290, the low-band mid channel bitstream 292, and the high-band mid channel BWE bitstream 294. The bitstream 290, 292, 294 may be multiplexed into a single bitstream, and the single bitstream may be transmitted to the decoder 118. In order to reduce coding complexity and redundant transmission, ICBWE gain mapping parameters are not encoded into the stereo downmix/upmix parameter bitstream 290. As described in detail with respect to FIG. 3, the ICBWE gain mapping parameters may be generated at the decoder 118 based on other stereo cues (e.g., DFT downmix stereo parameters).

Figure 3:
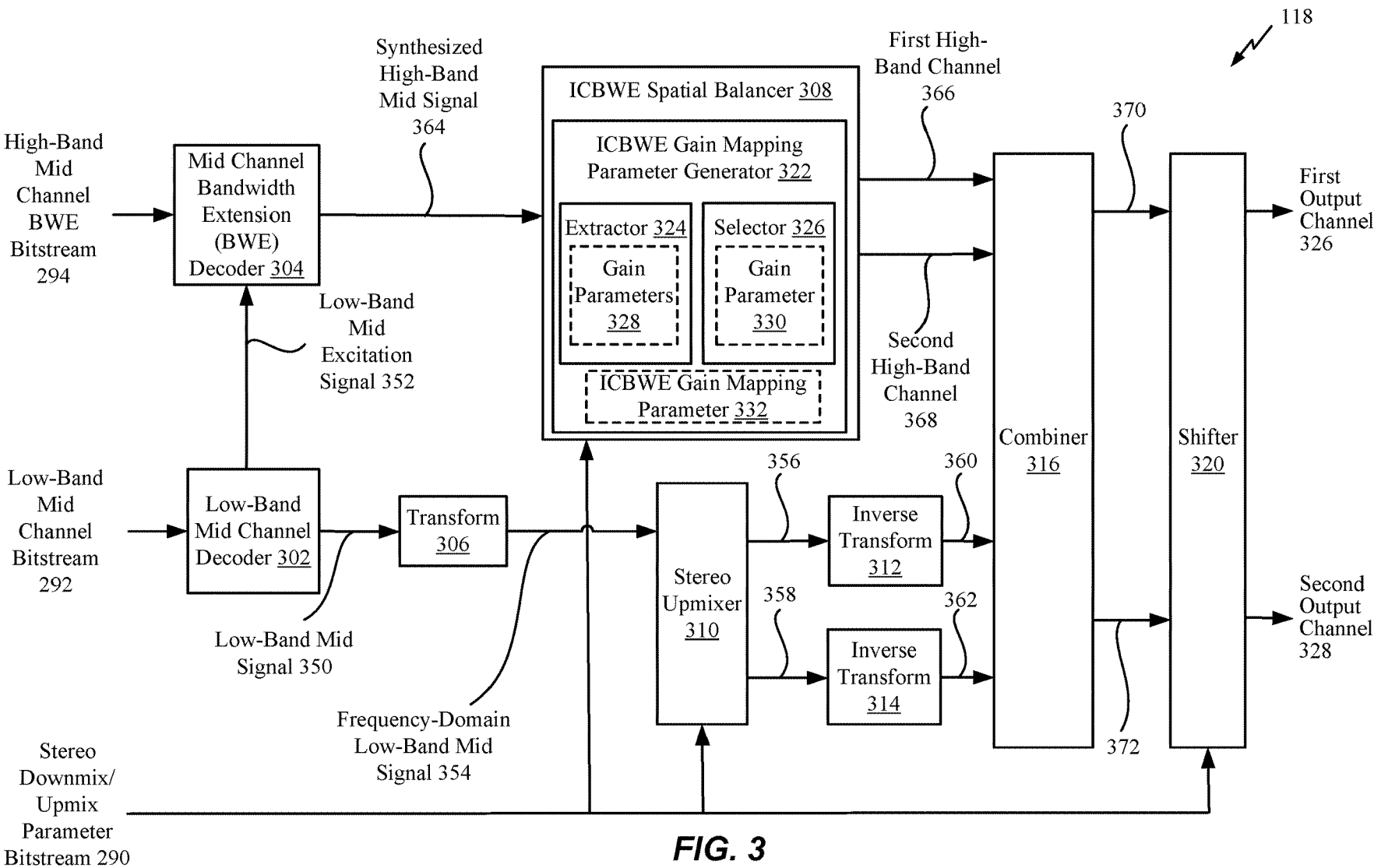
FIG. 3 is a diagram illustrating the decoder of FIG. 1.

Referring to FIG. 3, a particular implementation of the decoder 118 is shown. The decoder 118 includes a low-band mid channel decoder 302, a mid channel BWE decoder 304, a transform unit 306, an ICBWE spatial balancer 308, a stereo upmixer 310, an inverse transform unit 312, an inverse transform unit 314, a combiner 316, and a shifter 320.

The low-band mid channel bitstream 292 may be provided from the encoder 114 of FIG. 2 to the low-band mid channel decoder 302. The low-band mid channel decoder 302 may be configured to decode the low-band mid channel bitstream 292 to generate a low-band mid signal 350. The low-band mid channel decoder 302 may also be configured to generate an excitation of the low-band mid signal 350. For example, the low-band mid channel decoder 302 may generate a low-band mid excitation signal 352. The low-band mid signal 350 is provided to the transform unit 306, and the low-band mid excitation signal 352 is provided to the mid channel BWE decoder 304.

The transform unit 306 may be configured to perform a transform operation on the low-band mid signal 350 to generate a frequency-domain low-band mid signal 354. For example, the transform unit 306 may transform the low-band mid signal 350 from the time domain to the frequency domain. The frequency-domain low-band mid signal 354 is provided to the stereo upmixer 310.

The stereo upmixer 310 may be configured to perform an upmix operation on the frequency-domain low-band mid signal 354 using the stereo cues extracted from the stereo downmix/upmix parameter bitstream 290. For example, the stereo downmix/upmix parameter bitstream 290 may be provided (from the encoder 114) to the stereo upmixer 310. The stereo upmixer 310 may use the stereo cues associated with the stereo downmix/upmix parameter bitstream 290 to upmix the frequency-domain low-band mid signal 354 and to generate a first frequency-domain low-band channel 356 and a second frequency-domain low-band channel 358. The first frequency-domain low-band channel 356 is provided to the inverse transform unit 312, and the second frequency-domain low-band channel 358 is provided to the inverse transform unit 314.

The inverse transform unit 312 may be configured to perform an inverse transform operation on the first frequency-domain low-band channel 356 to generate a first low-band channel 360 (e.g., a time-domain channel). The first low-band channel 360 (e.g., a left low-band channel) is provided to the combiner 316. The inverse transform unit 314 may be configured to perform an inverse transform operation on the second frequency-domain low-band channel 358 to generate a second low-band channel 362 (e.g., a time-domain channel). The second low-band channel 362 (e.g., a right low-band channel) is also provided to the combiner 316.

The mid channel BWE decoder 304 may be configured to generate a synthesized high-band mid signal 364 based on the low-band mid excitation signal 352 and the mid channel BWE parameters encoded into the high-band mid channel BWE bitstream 294. For example, the high-band mid channel BWE bitstream 294 is provided (from the encoder 114) to the mid channel BWE decoder 304. A synthesis operation may be performed at the mid channel BWE decoder 304 by applying the mid channel BWE parameters to the low-band mid excitation signal 352. Based on the synthesis operation, the mid channel BWE decoder 304 may generate the synthesized high-band mid signal 364. The synthesized high-band mid signal 364 is provided to the ICBWE spatial balancer 308. In some implementations, the mid channel BWE decoder 304 may be included in the ICBWE spatial balancer 308. In other implementations, the ICBWE spatial balancer 308 may be included in the mid channel BWE decoder 304. In some particular implementations, the mid channel BWE parameters may not be explicitly determined, but rather, the first and second high-band channels may be generated directly.

The stereo downmix/upmix parameter bitstream 290 is provided (from the encoder 114) to the decoder 118. As described in FIG. 2, ICBWE gain mapping parameters are not included in the bitstream (e.g., the stereo downmix/upmix parameter bitstream 290) provided to the decoder 118. Therefore, in order to generate a first high-band channel 366 and a second high-band channel using an ICBWE spatial balancer 308, the ICBWE spatial balance 308 (or another component of the decoder 118) may generate an ICBWE gain mapping parameter 332 based on other stereo cues (e.g., DFT stereo parameters) encoded into the stereo downmix/upmix parameter bitstream 290.

The ICBWE spatial balancer 308 includes the ICBWE gain mapping parameter generator 322. Although the ICBWE gain mapping parameter generator 322 is included in the ICBWE spatial balancer 308, in other implementation, the ICBWE gain mapping parameter generator 322 may be included within a different component of the decoder 118, may be external to the decoder 118, or may a separate component of the decoder 118. The ICBWE gain mapping parameter generator 322 includes an extractor 324 and a selector 326. The extractor 324 may be configured to extract one or more frequency-domain gain parameters 328 from the stereo downmix/upmix parameter bitstream 290. The selector 326 may be configured to select a group of frequency-domain gain parameters 330 (from the one or more extracted frequency-domain gain parameters 328) for use in generation of the ICBWE gain mapping parameter 332.

According to one implementation, the ICBWE gain mapping parameter generator 322 may generate the ICBWE gain mapping parameter 332 for a wideband content using the following pseudocode:

```
if( st->bwidth == WB )
{
    /* copy to outputHB and reset hb_synth values */
    mvr2r( synthRef, synth, output_frame );
    if( st->element_mode == IVAS_CPE_TD ) /* time-domain stereo */
    {
        hStereoICBWE->prevSpecMapping = 0.0f;
        hStereoICBWE->prevgsMapping = 1.0f;
        hStereoICBWE->icbweM2Ref_prev = 1.0f;
    }
    else if( st->element_mode == IVAS_CPE_DFT ) /* frequency-domain stereo
*/
    {
        hStereoICBWE->refChanIndx_bwe = L_CH_INDX;
        hStereoICBWE->prevSpecMapping = 0.0f;
        prevgsMapping = hStereoICBWE->prevgsMapping;
        temp1 = hStereoDft->side_gain[ 2*STEREO_DFT_BAND_MAX + 9 ];
        temp2 = (1+temp1+STEREO_DFT_FLT_MIN)/(1-temp1+STEREO_DFT_FLT_MIN);
        hStereoICBWE->prevgsMapping = 2.0f/( 1.0f + temp2 );
        gsMapping = hStereoICBWE->prevgsMapping;
        winLen = (short)((SHB_OVERLAP_LEN * st->output_Fs)/16000);
        winSlope = 1.0f/winLen;
        alpha = winSlope;
        icbweM2Ref = (float)sqrt(2.0f - gsMapping * gsMapping);
        for( i = 0; i < winLen; i++ )
        {
            synthRef[i] *= (alpha * ( icbweM2Ref ) + (1.0f - alpha) * (
hStereoICBWE->icbweM2Ref_prev ));
                synth[i] *= (alpha * ( gsMapping ) + (1.0f - alpha) * (
prevgsMapping ));
            alpha += winSlope;
        }
        for(      ; i < NS2SA(st->output_Fs, FRAME_SIZE_NS); i++)
        {
            synthRef[i] *= ( icbweM2Ref );
                synth[i] *= ( gsMapping );
        }
        hStereoICBWE->icbweM2Ref_prev = icbweM2Ref;
    }
    return;
}
```

The selected frequency-domain gain parameter 330 may be selected based on a spectral proximity of a frequency range of the selected frequency-domain gain parameter 330 and a frequency range of the synthesized high-band mid signal 364. For example, a first frequency range of a first particular frequency-domain gain parameter may overlap the frequency range of the synthesized high-band mid signal 364 by a first amount, and a second frequency range of a second particular frequency-domain gain parameter may overlap the frequency range of the synthesized high-band mid signal 364 by a second amount. For example, if the first amount is greater than the second amount, the first particular frequency-domain gain parameter may be selected as the selected frequency-domain gain parameter 330. In an implementation where no frequency-domain gain parameters (of the extracted frequency-domain gain parameters 328) have a frequency range that overlaps the frequency range of the synthesized high-band mid signal 364, the frequency-domain gain parameter having a frequency range that is closest to the frequency range of the synthesized high-band mid signal 364 may be selected as the selected frequency-domain gain parameter 330.

As a non-limiting example of frequency-domain gain parameter selection, for Wideband coding, the synthesized high-band mid signal 364 may have a frequency range between 6.4 kilohertz (kHz) and 8 kHz. If the frequency-domain gain parameter 330 is associated with a frequency range between 5.2 kHz and 8.56 kHz, the frequency-domain gain parameter 330 may be selected to generate the ICBWE gain mapping parameter 332. For example, in the current implementations, the band number (b)=9 corresponds to frequency range between 5.28 and 8.56 kHz. Since the band includes the frequency range (6.4-8 khz), the sidegain of this band may be used directly to derive the ICBWE gain mapping parameter 322. In case there are no bands spanning the frequency range corresponding to the high-band (6.4-8 kHz), the band closest to the frequency range of the high-band may be used. In an example implementation where there are multiple frequency ranges corresponding to the high-band, then the side gains from each of the frequency ranges are weighted according to the frequency bandwidth to generate the final ICBWE gain mapping parameter, i.e., gsMapping=weight[b]*sidegain[b]+weight[b+1]*sidegain [b+1].

After the selector 326 selects the frequency-domain gain parameter 330, the ICBWE gain mapping parameter generator 322 may generate the ICBWE gain mapping parameter 332 using the frequency-domain gain parameter 330. According to one implementation, the ICBWE gain mapping parameter (gsMapping) 332 may be determined based on the selected frequency-domain gain parameter (sidegain) 330 using the following equation:

$$gsMapping=(1-sidegain)$$

For example, the side-gains may be alternative representations of the ILDs. The ILDs may be extracted (by the stereo cue estimator 206) in frequency bands based on the frequency-domain audio channels 252, 254. The relationship between the ILDs and the side-gains may be as approximately:

$$ILD(b) = \frac{1 + sidegain(b)}{1 - sidegain(b)}$$

Thus, the ICBWE gain mapping parameter 322 may also be expressed as:

$$gsMapping = \frac{2}{1 + ILD}$$

Once ICBWE gain mapping parameter generator 322 generates the ICBWE gain mapping parameter (gsMapping) 322, the ICBWE spatial balancer 308 may generate the first high-band channel 366 and the second high-band channel 368. For example, the ICBWE spatial balancer 308 may be configured to perform a gain scaling operation on the synthesized high-band mid signal 364 based on the ICBWE gain mapping parameter (gsMapping) 322 to generate the high-band channels 366. To illustrate, the ICBWE spatial balancer 308 may scale the synthesized high-band mid signal 364 by the difference between two and the ICBWE gain mapping parameter 332 (e.g., 2-gsMapping or $\sqrt{2-\text{gsMapping}^2}$) to generate the first high-band channel 366 (e.g., the left high-band channel), and the ICBWE spatial balancer 308 may scale the synthesized high-band mid signal 364 by the ICBWE gain mapping parameter 332 to generate the second high-band channel 368 (e.g., the right high-band channel). The high-band channels 366, 368 are provided to the combiner 316. In order to minimize inter-frame gain variation artifacts with ICBWE gain mapping, an overlap-add with a tapered window (e.g., a Sine(.) window or a triangular window) may be used at the frame boundaries when transitioning from the i-th frame's gsMapping parameter to the (i+1)-th frame's gsMapping parameter.

The ICBWE reference channel may be used at the combiner 316. For example, the combiner 316 may determine which high-band channel 366, 368 corresponds to the left channel and which high-band channel 366, 368 corresponds to the right channel. Thus, a reference channel indicator may be provided to the ICBWE spatial balancer 308 to indicate whether the left high-band channel corresponds to the first high-band channel 366 or to the second high-band channel 368. The combiner 316 may be configured to combine the first high-band channel 366 and the first low-band channel 360 to generate a first channel 370. For example, the combiner 316 may combine the left high-band channel and the left low-band channel 360 to generate a left channel. The combiner 316 may also be configured to combine the second high-band channel 368 and the second low-band channel 362 to generate a second channel 372. For example, the combiner 316 may combine the right high-band channel and the right low-band channel to generate a right channel. The first and second channels 370, 372 are provided to the shifter 320.

As an example, the first channel may be designated as the reference channel, and the second channel may be designated as the non-reference channel or the "target" channel. Thus, the second channel 372 may be subject to a shifting operation at the shifter 320. The shifter 320 may extract a shift value (e.g., the final shift value 116) from the stereo downmix/upmix parameter bitstream 290 and may shift the second channel 372 by the shift value to generate the second output channel 128. The shifter 320 may pass the first high-band channel 366 as the first output channel 126. In some implementations, the shifter 320 may be configured to perform a causal shifting on the target channel. In other implementations, the shifter 320 may be configured to perform a non-causal shifting on the reference channel. While in other implementations, the shifter 320 may be configured to perform a causal/non-causal shifting on the target/reference channels, respectively. Information indicating which channel is the target channel and which channel is the reference channel may be included as a part of the received bitstream. In some implementations, the shifter 320 may perform the shift operation in the time domain. In other implementations, the shift operation may be performed in the frequency domain. In some implementations, the shifter 320 may be included in the stereo upmixer 310. Thus, the shift operation may be performed on the low-band signals.

According to one implementation, the shifting operation may be independent of the ICBWE operations. For example, the reference channel indicator of the high-band may not be the same as reference channel indicator for the shifter 320. To illustrate, the high-band's reference channel (e.g., the reference channel associated with the ICBWE operations) may be different than the reference channel at the shifter 320. According to some implementations, a reference channel may not be designated at the shifter 320 and the shifter 320 may be configured to shift both channels 370, 372.

Thus, encoding complexity and transmission bandwidth may be reduced by omitting extraction and transmission of the ICBWE gain mapping parameters at the encoder 114. The ICBWE gain mapping parameters 332 may be generated at the decoder 118 based on other stereo parameters (e.g., frequency-domain gain parameters 328) included in the bitstream 290.

Figure 4:
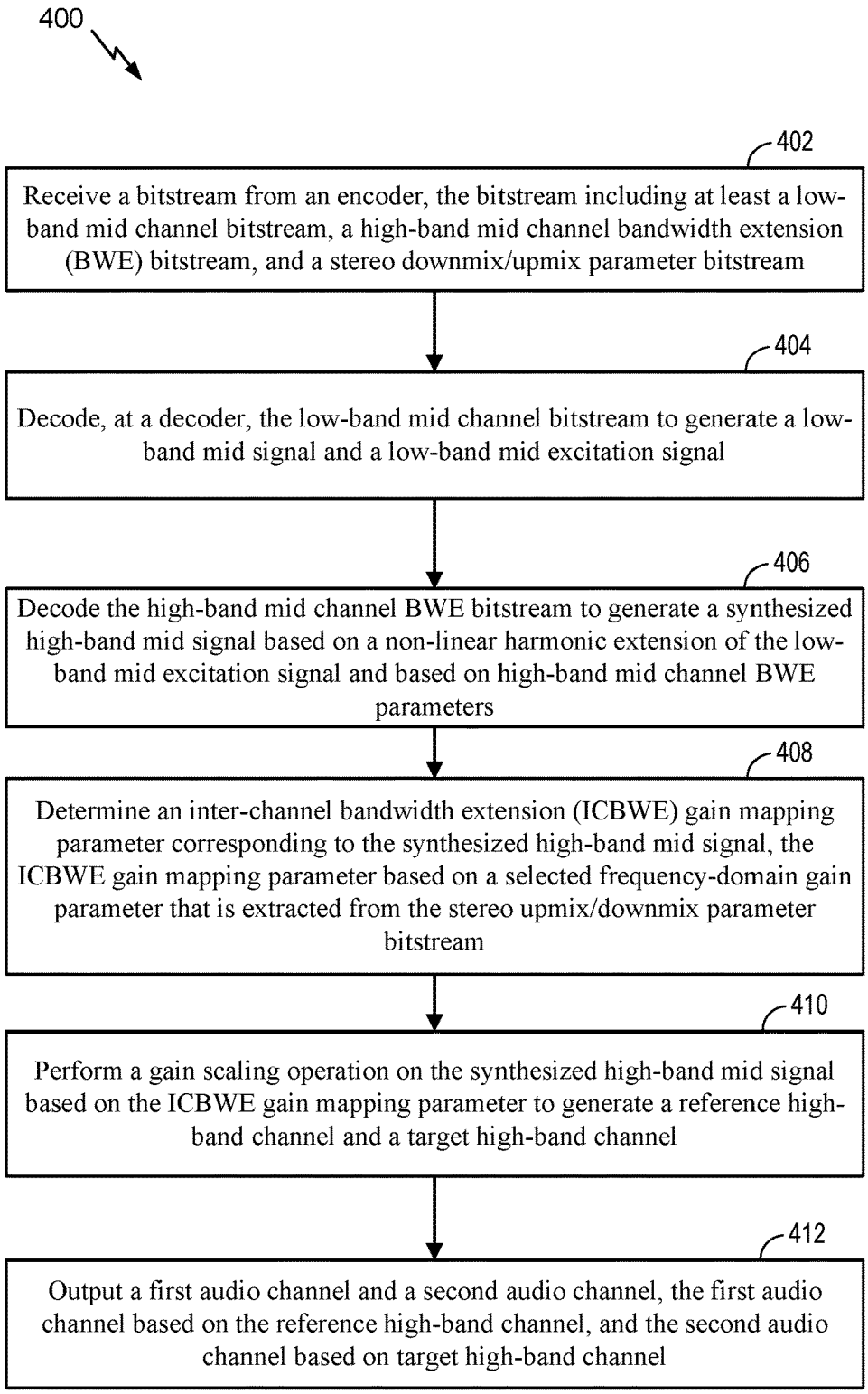
FIG. 4 is a flow chart illustrating a particular method of determining ICBWE mapping parameters based on a frequency-domain gain parameter transmitted from an encoder.

Referring to FIG. 4, a method 400 of determining ICBWE mapping parameters based on a frequency-domain gain parameter transmitted from an encoder is shown. The method 400 may be performed by the decoder 118 of FIGS. 1 and 3.

The method 400 includes receiving a bitstream from an encoder, at 402. The bitstream may include at least a low-band mid channel bitstream, a high-band mid channel BWE bitstream, and a stereo downmix/upmix parameter bitstream. For example, referring to FIG. 3, the decoder 118 may receive the stereo downmix/upmix parameter bitstream 290, the low-band mid channel bitstream 292, and the high-band mid channel BWE bitstream 294.

The method 400 also includes decoding the low-band mid channel bitstream to generate a low-band mid signal and a low-band mid excitation signal, at 404. For example, referring to FIG. 3, the low-band mid channel decoder 302 may decode the low-band mid channel bitstream 292 to generate the low-band mid signal 350. The low-band mid channel decoder 302 may also generate the low-band mid excitation signal 352.

The method 400 further includes decoding the high-band mid channel BWE bitstream to generate a synthesized high-band mid signal based on a non-linear harmonic extension of the low-band mid excitation signal and based on high-band channel BWE parameters, at 406. For example, the mid channel BWE decoder 304 may generate the synthesized high-band mid signal 364 based on the low-band mid excitation signal 352 and the mid channel BWE parameters encoded into the high-band mid channel BWE bitstream 294. To illustrate, a synthesis operation may be performed at the mid channel BWE decoder 304 by applying the mid channel BWE parameters to the low-band mid excitation signal 352. Based on the synthesis operation, the mid channel BWE decoder 304 may generate the synthesized high-band mid signal 364.

The method 400 also includes determining an ICBWE gain mapping parameter for the synthesized high-band mid signal based on a selected frequency-domain gain parameter that is extracted from the stereo downmix/upmix parameter bitstream, at 408. The selected frequency-domain gain parameter may be selected based on a spectral proximity of a frequency range of the selected frequency-domain gain parameter and a frequency range of the synthesized high-band mid signal. For example, referring to FIG. 3, the extractor may extract the frequency-domain gain parameters 328 from the stereo downmix/upmix parameter bitstream 290, and the selector 326 may select the frequency-domain gain parameter 330 (from the one or more extracted frequency-domain gain parameters 328) for use in generation of the ICBWE gain mapping parameter 332. Thus, according to one implementation, the method 400 may also include extracting one or more frequency-domain gain parameters from the stereo parameter bitstream. The selected frequency-domain gain parameter may be selected from the one or more frequency-domain gain parameters.

The selected frequency-domain gain parameter 330 may be selected based on a spectral proximity of a frequency range of the selected frequency-domain gain parameter 330 and a frequency range of the synthesized high-band mid signal 364. To illustrate, for Wideband coding, the synthesized high-band mid signal 364 may have a frequency range between 6.4 kilohertz (kHz) and 8 kHz. If the frequency-domain gain parameter 330 is associated with a frequency range between 5.2 kHz and 8.56 kHz, the frequency-domain gain parameter 330 may be selected to generate the ICBWE gain mapping parameter 332.

After the selector 326 selects the frequency-domain gain parameter 330, the ICBWE gain mapping parameter generator 322 may generate the ICBWE gain mapping parameter 332 using the frequency-domain gain parameter 330. According to one implementation, the ICBWE gain mapping parameter (gsMapping) 332 may be determined based on the selected frequency-domain gain parameter (sidegain) 330 using the following equation:

$$gsMapping = \frac{2}{1 + \frac{1 + sidegain}{1 - sidegain}}$$

The method 400 further includes performing a gain scaling operation on the synthesized high-band mid signal based on the ICBWE gain mapping parameter to generate a reference high-band channel and a target high-band channel, at 410. Performing the gain scaling operation may include scaling the synthesized high-band mid signal by the ICBWE gain mapping parameter to generate the right high-band channel. For example, referring to FIG. 3, the ICBWE spatial balancer 308 may scale the synthesized high-band mid signal 364 by the ICBWE gain mapping parameter 332 to generate the second high-band channel 368 (e.g., the right high-band channel). Performing the gain scaling operation may also include scaling the synthesized high-band mid signal by a difference between two and the ICBWE gain mapping parameter to generate the left high-band channel. For example, referring to FIG. 3, the ICBWE spatial balancer 308 may scale the synthesized high-band mid signal 364 by the difference between two and the ICBWE gain mapping parameter 332 (e.g., 2-gsMapping) to generate the first high-band channel 366 (e.g., the left high-band channel).

The method 400 also includes outputting a first audio channel and a second audio channel, at 412. The first audio channel may be based on the reference high-band channel, and the second audio channel may be based on target high-band channel. For example, referring to FIG. 1, the second device 106 may output the first output channel 126 (e.g., the first audio channel based on the left channel 370) and the second output channel 128 (e.g., the second audio channel based on the right channel 372).

Thus, according to the method 400, encoding complexity and transmission bandwidth may be reduced by omitting extraction and transmission of the ICBWE gain mapping parameters at the encoder 114. The ICBWE gain mapping parameters 332 may be generated at the decoder 118 based on other stereo parameters (e.g., frequency-domain gain parameters 328) included in the bitstream 290.

Figure 5:
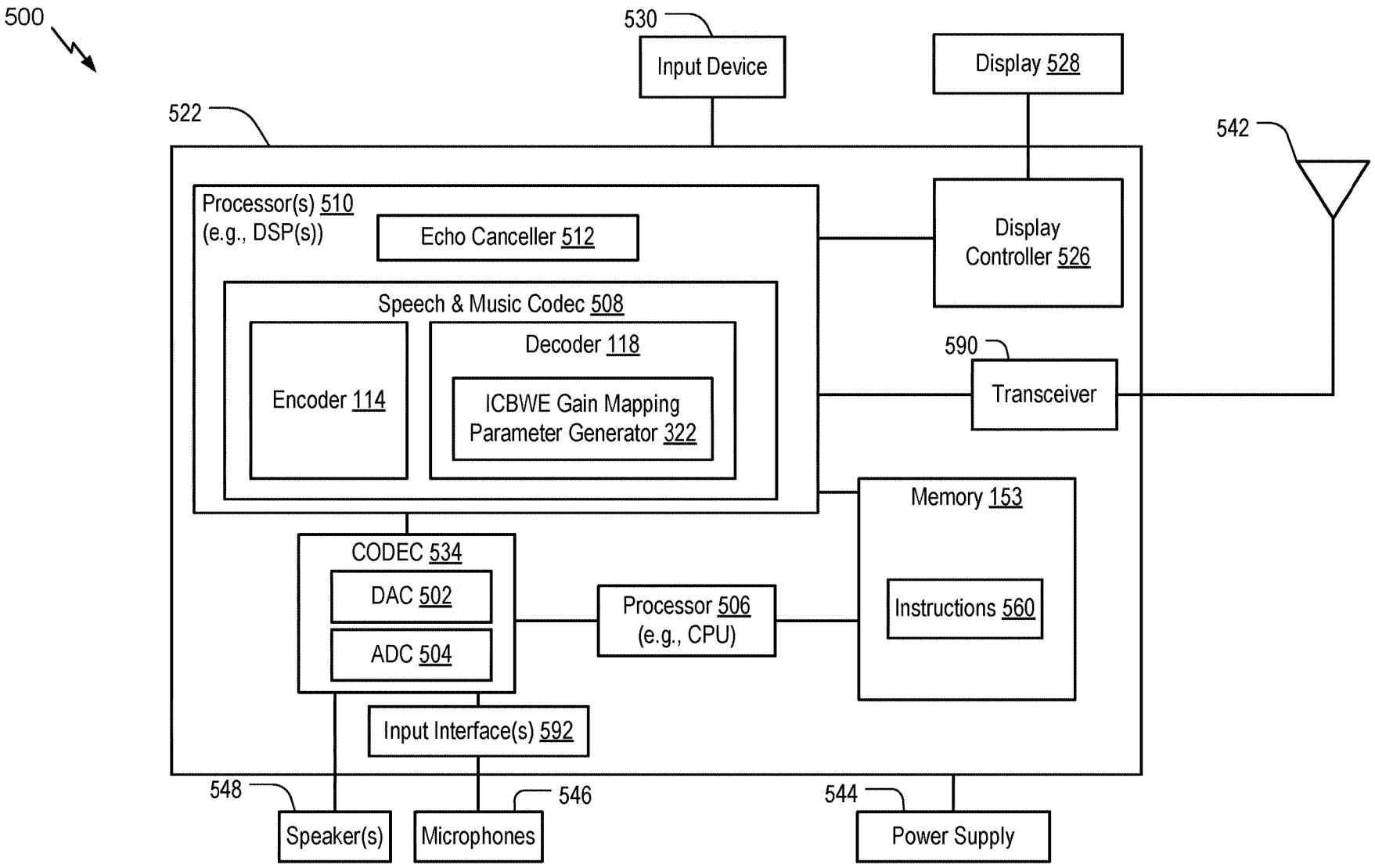
FIG. 5 is a block diagram of a particular illustrative example of a device that is operable to determine ICBWE mapping parameters based on a frequency-domain gain parameter transmitted from an encoder.

Referring to FIG. 5, a block diagram of a particular illustrative example of a device (e.g., a wireless communication device) is depicted and generally designated 500. In various implementations, the device 500 may have fewer or more components than illustrated in FIG. 5. In an illustrative implementation, the device 500 may correspond to the second device 106 of FIG. 1. In an illustrative implementation, the device 500 may perform one or more operations described with reference to systems and methods of FIGS. 1-4.

In a particular implementation, the device 500 includes a processor 506 (e.g., a central processing unit (CPU)). The device 500 may include one or more additional processors 510 (e.g., one or more digital signal processors (DSPs)). The processors 510 may include a media (e.g., speech and music) coder-decoder (CODEC) 508, and an echo canceller 512. The media CODEC 508 may include the decoder 118, the encoder 114, or both, of FIG. 1. The decoder 118 may include the ICBWE gain mapping parameter generator 322.

The device 500 may include a memory 153 and a CODEC 534. Although the media CODEC 508 is illustrated as a component of the processors 510 (e.g., dedicated circuitry and/or executable programming code), in other implementations one or more components of the media CODEC 508, such as the decoder 118, the encoder 114, or both, may be included in the processor 506, the CODEC 534, another processing component, or a combination thereof.

The device 500 may include a transceiver 590 coupled to an antenna 542. The device 500 may include a display 528 coupled to a display controller 526. One or more speakers 548 may be coupled to the CODEC 534. One or more microphones 546 may be coupled, via an input interface(s) 592, to the CODEC 534. In a particular implementation, the speakers 548 may include the first loudspeaker 142, the second loudspeaker 144 of FIG. 1, or a combination thereof. The CODEC 534 may include a digital-to-analog converter (DAC) 502 and an analog-to-digital converter (ADC) 504.

The memory 153 may include instructions 560 executable by the decoder 118, the processor 506, the processors 510, the CODEC 534, another processing unit of the device 500, or a combination thereof, to perform one or more operations described with reference to FIGS. 1-4.

For example, the instructions 560 may be executable to cause the processor 510 to decode the low-band mid channel bitstream 292 to generate the low-band mid signal 350 and the low-band mid excitation signal 352. The instructions 560 may further be executable to cause the processor 510 to decode the high-band mid channel BWE bitstream 294 based on the low-band mid excitation signal 352 to generate the synthesized high-band mid signal 364. The instructions 560 may also be executable to cause the processor 510 to determine the ICBWE gain mapping parameter 332 for the synthesized high-band mid signal 364 based on the selected frequency-domain gain parameter 330 that is extracted from the stereo downmix/upmix parameter bitstream 290. The selected frequency-domain gain parameter 330 may be selected based on a spectral proximity of a frequency range of the selected frequency-domain gain parameter 330 and a frequency range of the synthesized high-band mid signal 364. The instructions 560 may further be executable to cause the processor 510 to perform a gain scaling operation on the synthesized high-band mid signal 364 based on the ICBWE gain mapping parameter 332 to generate the first high-band channel 366 (e.g., the left high-band channel) and the second high-band channel 368 (e.g., the right high-band channel). The instructions 560 may also be executable to cause the processor 510 to generate the first output channel 326 and the second output channel 328.

One or more components of the device 500 may be implemented via dedicated hardware (e.g., circuitry), by a processor executing instructions to perform one or more tasks, or a combination thereof. As an example, the memory 153 or one or more components of the processor 506, the processors 510, and/or the CODEC 534 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 560) that, when executed by a computer (e.g., a processor in the CODEC 534, the decoder 118, the processor 506, and/or the processors 510), may cause the computer to perform one or more operations described with reference to FIGS. 1-4. As an example, the memory 153 or the one or more components of the processor 506, the processors 510, and/or the CODEC 534 may be a non-transitory computer-readable medium that includes instructions (e.g., the instructions 560) that, when executed by a computer (e.g., a processor in the CODEC 534, the decoder 118, the processor 506, and/or the processors 510), cause the computer perform one or more operations described with reference to FIGS. 1-4.

In a particular implementation, the device 500 may be included in a system-in-package or system-on-chip device (e.g., a mobile station modem (MSM)) 522. In a particular implementation, the processor 506, the processors 510, the display controller 526, the memory 153, the CODEC 534, and the transceiver 590 are included in a system-in-package or the system-on-chip device 522. In a particular implementation, an input device 530, such as a touchscreen and/or keypad, and a power supply 544 are coupled to the system-on-chip device 522. Moreover, in a particular implementation, as illustrated in FIG. 5, the display 528, the input device 530, the speakers 548, the microphones 546, the antenna 542, and the power supply 544 are external to the system-on-chip device 522. However, each of the display 528, the input device 530, the speakers 548, the microphones 546, the antenna 542, and the power supply 544 can be coupled to a component of the system-on-chip device 522, such as an interface or a controller.

The device 500 may include a wireless telephone, a mobile communication device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

In a particular implementation, one or more components of the systems and devices disclosed herein may be integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

It should be noted that various functions performed by the one or more components of the systems and devices disclosed herein are described as being performed by certain components or modules. This division of components and modules is for illustration only. In an alternate implementation, a function performed by a particular component or module may be divided amongst multiple components or modules. Moreover, in an alternate implementation, two or more components or modules may be integrated into a single component or module. Each component or module may be implemented using hardware (e.g., a field-programmable gate array (FPGA) device, an application-specific integrated circuit (ASIC), a DSP, a controller, etc.), software (e.g., instructions executable by a processor), or any combination thereof.

In conjunction with the described implementations, an apparatus includes means for receiving a bitstream from an encoder. The bitstream may include a low-band mid channel bitstream, a mid channel BWE bitstream, and a stereo parameter bitstream. For example, the means for receiving may include the second device 106 of FIG. 1, the antenna 542 of FIG. 5, the transceiver 590 of FIG. 5, one or more other devices, modules, circuits, components, or a combination thereof.

The apparatus may also include means for decoding the low-band mid channel bitstream to generate a low-band mid signal and a low-band mid channel excitation of the low-band mid signal. For example, the means for decoding the low-band mid channel bitstream may include the decoder 118 of FIGS. 1, 3, and 5, the low-band mid channel decoder 302 of FIG. 3, the CODEC 508 of FIG. 5, the processors 510, the processor 506 of FIG. 5, the device 500, the instructions 560 executable by a processor, one or more other device, modules, circuits, components, or a combination thereof.

The apparatus may also include means for decoding the mid channel BWE bitstream based on the low-band mid channel excitation to generate a synthesized high-band mid signal. For example, the means for decoding the mid channel BWE bitstream may include the decoder 118 of FIGS. 1, 3, and 5, the mid channel BWE decoder 304 of FIG. 3, the CODEC 508 of FIG. 5, the processors 510, the processor 506 of FIG. 5, the device 500, the instructions 560 executable by a processor, one or more other device, modules, circuits, components, or a combination thereof.

The apparatus may also include means for determining an ICBWE gain mapping parameter for the synthesized high-band mid signal based on a selected frequency-domain gain parameter that is extracted from the stereo parameter bitstream. The selected frequency-domain gain parameter may be selected based on a spectral proximity of a frequency range of the selected frequency-domain gain parameter and a frequency range of the synthesized high-band mid signal. For example, the means for determining the ICBWE gain mapping parameter may include the decoder 118 of FIGS. 1, 3, and 5, the ICBWE spatial balancer 308 of FIG. 3, the ICBWE gain mapping parameter generator 322 of FIG. 3, the extractor 324 of FIG. 3, the selector 326 of FIG. 3, the CODEC 508 of FIG. 5, the processors 510, the processor 506 of FIG. 5, the device 500, the instructions 560 executable by a processor, one or more other device, modules, circuits, components, or a combination thereof.

The apparatus may also include means for performing a gain scaling operation on the synthesized high-band mid signal based on the ICBWE gain mapping parameter to generate a left high-band channel and a right high-band channel. For example, the means for performing the gain scaling operation may include the decoder 118 of FIGS. 1, 3, and 5, the ICBWE spatial balancer 308 of FIG. 3, the CODEC 508 of FIG. 5, the processors 510, the processor 506 of FIG. 5, the device 500, the instructions 560 executable by a processor, one or more other device, modules, circuits, components, or a combination thereof.

The apparatus may also include means for outputting a first audio channel and a second audio channel. The first audio channel may be based on the left high-band channel, and the second audio channel may be based on the right high-band channel. For example, the means for outputting may include the first loudspeaker 142 of FIG. 1, the second loudspeaker 144 of FIG. 1, the speakers 548 of FIG. 5, one or more other device, modules, circuits, components, or a combination thereof.

Figure 6:
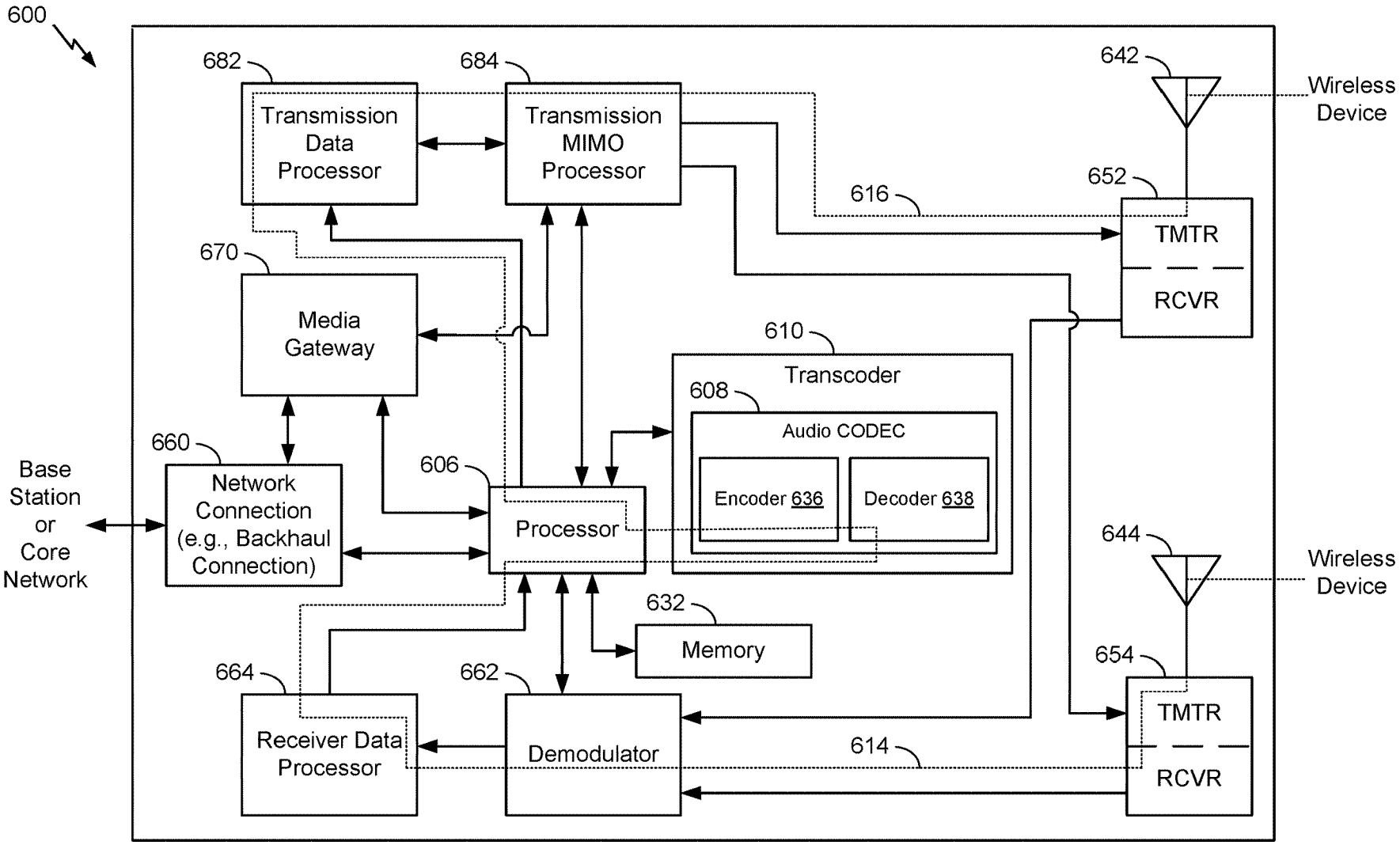
FIG. 6 is a block diagram of a base station that is operable to determine ICBWE mapping parameters based on a frequency-domain gain parameter transmitted from an encoder.

Referring to FIG. 6, a block diagram of a particular illustrative example of a base station 600 is depicted. In various implementations, the base station 600 may have more components or fewer components than illustrated in FIG. 6. In an illustrative example, the base station 600 may include the second device 106 of FIG. 1. In an illustrative example, the base station 600 may operate according to one or more of the methods or systems described with reference to FIGS. 1-5.

The base station 600 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1×, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 500 of FIG. 5.

Various functions may be performed by one or more components of the base station 600 (and/or in other components not shown), such as sending and receiving messages and data (e.g., audio data). In a particular example, the base station 600 includes a processor 606 (e.g., a CPU). The base station 600 may include a transcoder 610. The transcoder 610 may include an audio CODEC 608. For example, the transcoder 610 may include one or more components (e.g., circuitry) configured to perform operations of the audio CODEC 608. As another example, the transcoder 610 may be configured to execute one or more computer-readable instructions to perform the operations of the audio CODEC 608. Although the audio CODEC 608 is illustrated as a component of the transcoder 610, in other examples one or more components of the audio CODEC 608 may be included in the processor 606, another processing component, or a combination thereof. For example, a decoder 638 (e.g., a vocoder decoder) may be included in a receiver data processor 664. As another example, an encoder 636 (e.g., a vocoder encoder) may be included in a transmission data processor 682. The encoder 636 may include the encoder 114 of FIG. 1. The decoder 638 may include the decoder 118 of FIG. 1.

The transcoder 610 may function to transcode messages and data between two or more networks. The transcoder 610 may be configured to convert message and audio data from a first format (e.g., a digital format) to a second format. To illustrate, the decoder 638 may decode encoded signals having a first format and the encoder 636 may encode the decoded signals into encoded signals having a second format. Additionally or alternatively, the transcoder 610 may be configured to perform data rate adaptation. For example, the transcoder 610 may down-convert a data rate or up-convert the data rate without changing a format the audio data. To illustrate, the transcoder 610 may down-convert 64 kbit/s signals into 16 kbit/s signals.

The base station 600 may include a memory 632. The memory 632, such as a computer-readable storage device, may include instructions. The instructions may include one or more instructions that are executable by the processor 606, the transcoder 610, or a combination thereof, to perform one or more operations described with reference to the methods and systems of FIGS. 1-5.

The base station 600 may include multiple transmitters and receivers (e.g., transceivers), such as a first transceiver 652 and a second transceiver 654, coupled to an array of antennas. The array of antennas may include a first antenna 642 and a second antenna 644. The array of antennas may be configured to wirelessly communicate with one or more wireless devices, such as the device 500 of FIG. 5. For example, the second antenna 644 may receive a data stream 614 (e.g., a bit stream) from a wireless device. The data stream 614 may include messages, data (e.g., encoded speech data), or a combination thereof.

The base station 600 may include a network connection 660, such as backhaul connection. The network connection 660 may be configured to communicate with a core network or one or more base stations of the wireless communication network. For example, the base station 600 may receive a second data stream (e.g., messages or audio data) from a core network via the network connection 660. The base station 600 may process the second data stream to generate messages or audio data and provide the messages or the audio data to one or more wireless device via one or more antennas of the array of antennas or to another base station via the network connection 660. In a particular implementation, the network connection 660 may be a wide area network (WAN) connection, as an illustrative, non-limiting example. In some implementations, the core network may include or correspond to a Public Switched Telephone Network (PSTN), a packet backbone network, or both.

The base station 600 may include a media gateway 670 that is coupled to the network connection 660 and the processor 606. The media gateway 670 may be configured to convert between media streams of different telecommunications technologies. For example, the media gateway 670 may convert between different transmission protocols, different coding schemes, or both. To illustrate, the media gateway 670 may convert from PCM signals to Real-Time Transport Protocol (RTP) signals, as an illustrative, non-limiting example. The media gateway 670 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 670 may include a transcoder, such as the transcoder 610, and may be configured to transcode data when codecs are incompatible. For example, the media gateway 670 may transcode between an Adaptive Multi-Rate (AMR) codec and a G.711 codec, as an illustrative, non-limiting example. The media gateway 670 may include a router and a plurality of physical interfaces. In some implementations, the media gateway 670 may also include a controller (not shown). In a particular implementation, the media gateway controller may be external to the media gateway 670, external to the base station 600, or both. The media gateway controller may control and coordinate operations of multiple media gateways. The media gateway 670 may receive control signals from the media gateway controller and may function to bridge between different transmission technologies and may add service to end-user capabilities and connections.

The base station 600 may include a demodulator 662 that is coupled to the transceivers 652, 654, the receiver data processor 664, and the processor 606, and the receiver data processor 664 may be coupled to the processor 606. The demodulator 662 may be configured to demodulate modulated signals received from the transceivers 652, 654 and to provide demodulated data to the receiver data processor 664. The receiver data processor 664 may be configured to extract a message or audio data from the demodulated data and send the message or the audio data to the processor 606.

The base station 600 may include a transmission data processor 682 and a transmission multiple input-multiple output (MIMO) processor 684. The transmission data processor 682 may be coupled to the processor 606 and the transmission MIMO processor 684. The transmission MIMO processor 684 may be coupled to the transceivers 652, 654 and the processor 606. In some implementations, the transmission MIMO processor 684 may be coupled to the media gateway 670. The transmission data processor 682 may be configured to receive the messages or the audio data from the processor 606 and to code the messages or the audio data based on a coding scheme, such as CDMA or orthogonal frequency-division multiplexing (OFDM), as an illustrative, non-limiting examples. The transmission data processor 682 may provide the coded data to the transmission MIMO processor 684.

The coded data may be multiplexed with other data, such as pilot data, using CDMA or OFDM techniques to generate multiplexed data. The multiplexed data may then be modulated (i.e., symbol mapped) by the transmission data processor 682 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 606.

The transmission MIMO processor 684 may be configured to receive the modulation symbols from the transmission data processor 682 and may further process the modulation symbols and may perform beamforming on the data. For example, the transmission MIMO processor 684 may apply beamforming weights to the modulation symbols.

During operation, the second antenna 644 of the base station 600 may receive a data stream 614. The second transceiver 654 may receive the data stream 614 from the second antenna 644 and may provide the data stream 614 to the demodulator 662. The demodulator 662 may demodulate modulated signals of the data stream 614 and provide demodulated data to the receiver data processor 664. The receiver data processor 664 may extract audio data from the demodulated data and provide the extracted audio data to the processor 606.

The processor 606 may provide the audio data to the transcoder 610 for transcoding. The decoder 638 of the transcoder 610 may decode the audio data from a first format into decoded audio data and the encoder 636 may encode the decoded audio data into a second format. In some implementations, the encoder 636 may encode the audio data using a higher data rate (e.g., up-convert) or a lower data rate (e.g., down-convert) than received from the wireless device. In other implementations the audio data may not be transcoded. Although transcoding (e.g., decoding and encoding) is illustrated as being performed by a transcoder 610, the transcoding operations (e.g., decoding and encoding) may be performed by multiple components of the base station 600. For example, decoding may be performed by the receiver data processor 664 and encoding may be performed by the transmission data processor 682. In other implementations, the processor 606 may provide the audio data to the media gateway 670 for conversion to another transmission protocol, coding scheme, or both. The media gateway 670 may provide the converted data to another base station or core network via the network connection 660.

Encoded audio data generated at the encoder 636 may be provided to the transmission data processor 682 or the network connection 660 via the processor 606. The transcoded audio data from the transcoder 610 may be provided to the transmission data processor 682 for coding according to a modulation scheme, such as OFDM, to generate the modulation symbols. The transmission data processor 682 may provide the modulation symbols to the transmission MIMO processor 684 for further processing and beamforming. The transmission MIMO processor 684 may apply beamforming weights and may provide the modulation symbols to one or more antennas of the array of antennas, such as the first antenna 642 via the first transceiver 652. Thus, the base station 600 may provide a transcoded data stream 616, that corresponds to the data stream 614 received from the wireless device, to another wireless device. The transcoded data stream 616 may have a different encoding format, data rate, or both, than the data stream 614. In other implementations, the transcoded data stream 616 may be provided to the network connection 660 for transmission to another base station or a core network.

Those of skill would further appreciate that the various illustrative logical blocks, configurations, modules, circuits, and algorithm steps described in connection with the implementations disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A device comprising:

a receiver configured to receive a bitstream from an encoder, the bitstream comprising at least a low-band mid channel bitstream, a high-band mid channel bandwidth extension (BWE) bitstream, and a stereo downmix/upmix parameter bitstream;

a decoder configured to:

decode the low-band mid channel bitstream to generate a low-band mid signal and a low-band mid excitation signal;

generate a non-linear harmonic extension of the low-band mid excitation signal corresponding to a high-band BWE portion;

decode the high-band mid channel BWE bitstream to generate a synthesized high-band mid signal based on the non-linear harmonic extension of the low-band mid excitation signal and based on high-band mid channel BWE parameters;

determine an inter-channel bandwidth extension (ICBWE) gain mapping parameter corresponding to the synthesized high-band mid signal, the ICBWE gain mapping parameter based on a set of gain parameters that are extracted from the stereo downmix/upmix parameter bitstream; and perform a gain scaling operation on the synthesized high-band mid signal based on the ICBWE gain mapping parameter to generate a reference high-band channel and a target high-band channel; and one or more speakers configured to output a first audio channel and a second audio channel, the first audio channel based on the reference high-band channel, and the second audio channel based on the target high-band channel.

2. The device of claim 1, wherein the set of gain parameters is selected based on a spectral proximity of a frequency range of the set of gain parameters and a frequency range of the synthesized high-band mid signal.

3. The device of claim 1, wherein the set of gain parameters corresponds to a side gain of the stereo downmix/upmix parameter bitstream or interchannel level difference (ILD) of the stereo downmix/upmix parameter bitstream.

4. The device of claim 1, wherein the reference high-band channel corresponds to a left high-band channel or a right high-band channel, and wherein the target high-band channel corresponds to the other of the left high-band channel or the right high-band channel.

5. The device of claim 4, wherein the decoder is further configured to generate, based on the low-band mid signal, a left low-band channel and a right low-band channel.

6. The device of claim 5, wherein the decoder is further configured to:

combine the left low-band channel and the left high-band channel to generate the first audio channel; and combine the right low-band channel and the right high-band channel to generate the second audio channel.

7. The device of claim 1, wherein the decoder is further configured to extract one or more frequency-domain gain parameters from the stereo downmix/upmix parameter bitstream, wherein the set of gain parameters is selected from the one or more frequency-domain gain parameters.

8. The device of claim 1, wherein the decoder is configured to scale the synthesized high-band mid signal by the ICBWE gain mapping parameter to generate the target high-band channel.

9. The device of claim 1, wherein side gains from multiple frequency ranges of a high band are weighted based on frequency bandwidths of each frequency range of the multiple frequency ranges to generate the ICBWE gain mapping parameter.

10. The device of claim 1, wherein the decoder is integrated into a base station.

11. The device of claim 1, wherein the decoder is integrated into a mobile device.

12. A method of decoding a signal, the method comprising:

receiving a bitstream from an encoder, the bitstream comprising at least a low-band mid channel bitstream, a high-band mid channel bandwidth extension (BWE) bitstream, and a stereo downmix/upmix parameter bitstream;

decoding, at a decoder, the low-band mid channel bitstream to generate a low-band mid signal and a low-band mid excitation signal;

generating a non-linear harmonic extension of the low-band mid excitation signal corresponding to a high-band BWE portion;

decoding the high-band mid channel BWE bitstream to generate a synthesized high-band mid signal based on the non-linear harmonic extension of the low-band mid excitation signal and based on high-band mid channel BWE parameters;

determining an inter-channel bandwidth extension (ICBWE) gain mapping parameter corresponding to the synthesized high-band mid signal, the ICBWE gain mapping parameter based on a selected frequency-domain gain parameter that is extracted from the stereo downmix/upmix parameter bitstream;

performing a gain scaling operation on the synthesized high-band mid signal based on the ICBWE gain mapping parameter to generate a reference high-band channel and a target high-band channel; and outputting a first audio channel and a second audio channel, the first audio channel based on the reference high-band channel, and the second audio channel based on the target high-band channel.

13. The method of claim 12, wherein the selected frequency-domain gain parameter is selected based on a spectral proximity of a frequency range of the selected frequency-domain gain parameter and a frequency range of the synthesized high-band mid signal.

14. The method of claim 12, wherein the reference high-band channel corresponds to a left high-band channel or a right high-band channel, and wherein the target high-band channel corresponds to the other of the left high-band channel or the right high-band channel.

15. The method of claim 14, further comprising generating, based on the low-band mid signal, a left low-band channel and a right low-band channel.

16. The method of claim 15, further comprising:

combining the left low-band channel and the left high-band channel to generate the first audio channel; and combining the right low-band channel and the right high-band channel to generate the second audio channel.

17. The method of claim 12, further comprising extracting one or more frequency-domain gain parameters from the stereo downmix/upmix parameter bitstream, wherein the selected frequency-domain gain parameter is selected from the one or more frequency-domain gain parameters.

18. The method of claim 12, wherein performing the gain scaling operation comprises scaling the synthesized high-band mid signal by the ICBWE gain mapping parameter to generate the target high-band channel.

19. The method of claim 12, wherein determining the ICBWE gain mapping parameter for the synthesized high-band mid signal is performed at a base station.

20. The method of claim 12, wherein determining the ICBWE gain mapping parameter for the synthesized high-band mid signal is performed at a mobile device.

21. A non-transitory computer-readable medium comprising instructions for decoding a signal, the instructions, when executed by a processor within a decoder, cause the processor to perform operations comprising:

receiving a bitstream from an encoder, the bitstream comprising at least a low-band mid channel bitstream, a high-band mid channel bandwidth extension (BWE) bitstream, and a stereo downmix/upmix parameter bitstream;

decoding the low-band mid channel bitstream to generate a low-band mid signal and a low-band mid excitation signal;

generating a non-linear harmonic extension of the low-band mid excitation signal corresponding to a high-band BWE portion;

decoding the high-band mid channel BWE bitstream to generate a synthesized high-band mid signal based on the non-linear harmonic extension of the low-band mid excitation signal and based on high-band mid channel BWE parameters;

determining an inter-channel bandwidth extension (ICBWE) gain mapping parameter corresponding to the synthesized high-band mid signal, the ICBWE gain mapping parameter based on a selected frequency-domain gain parameter that is extracted from the stereo downmix/upmix parameter bitstream;

performing a gain scaling operation on the synthesized high-band mid signal based on the ICBWE gain mapping parameter to generate a left high-band channel and a right high-band channel; and generating a first audio channel and a second audio channel, the first audio channel based on the left high-band channel, and the second audio channel based on the right high-band channel.

22. The non-transitory computer-readable medium of claim 21, wherein the selected frequency-domain gain parameter is selected based on a spectral proximity of a frequency range of the selected frequency-domain gain parameter and a frequency range of the synthesized high-band mid signal.

23. The non-transitory computer-readable medium of claim 21, wherein the reference high-band channel corresponds to a left high-band channel or a right high-band channel, and wherein the target high-band channel corresponds to the other of the left high-band channel or the right high-band channel.

24. The non-transitory computer-readable medium of claim 23, wherein the operations further comprise generating, based on the low-band mid signal, a left low-band channel and a right low-band channel.

25. The non-transitory computer-readable medium of claim 24, wherein the operations further comprise:

combining the left low-band channel and the left high-band channel to generate the first audio channel; and combining the right low-band channel and the right high-band channel to generate the second audio channel.

26. The non-transitory computer-readable medium of claim 21, wherein the operations further comprise extracting one or more frequency-domain gain parameters from the stereo downmix/upmix parameter bitstream, wherein the selected frequency-domain gain parameter is selected from the one or more frequency-domain gain parameters.

27. The non-transitory computer-readable medium of claim 21, wherein performing the gain scaling operation comprises scaling the synthesized high-band mid signal by the ICBWE gain mapping parameter to generate the target high-band channel.

28. An apparatus comprising:

means for receiving a bitstream from an encoder, the bitstream comprising at least a low-band mid channel bitstream, a high-band mid channel bandwidth extension (BWE) bitstream, and a stereo downmix/upmix parameter bitstream;

means for decoding the low-band mid channel bitstream to generate a low-band mid signal and a low-band mid excitation signal;

means for generating a non-linear harmonic extension of the low-band mid excitation signal corresponding to a high-band BWE portion;

means for decoding the high-band mid channel BWE bitstream to generate a synthesized high-band mid signal based on the non-linear harmonic extension of the low-band mid excitation signal and based on high-band mid channel BWE parameters;

means for determining an inter-channel bandwidth extension (ICBWE) gain mapping parameter corresponding to the synthesized high-band mid signal, the ICBWE gain mapping parameter based on a selected frequency-domain gain parameter that is extracted from the stereo downmix/upmix parameter bitstream;

means for performing a gain scaling operation on the synthesized high-band mid signal based on the ICBWE gain mapping parameter to generate a left high-band channel and a right high-band channel; and means for outputting a first audio channel and a second audio channel, the first audio channel based on the left high-band channel, and the second audio channel based on the right high-band channel.

29. The apparatus of claim 28, wherein the means for determining the ICBWE gain mapping parameter is integrated into a base station.

30. The apparatus of claim 28, wherein the means for determining the ICBWE gain mapping parameter is integrated into a mobile device.

* * * * *